US010569115B2

(12) United States Patent
Tran et al.

(10) Patent No.: US 10,569,115 B2
(45) Date of Patent: Feb. 25, 2020

(54) METHODS AND SYSTEMS FOR DISRUPTING PHENOMENA WITH WAVES

(71) Applicant: FORCE SV, LLC, Fairfax, VA (US)

(72) Inventors: Viet Minh Tran, Sterling, VA (US); Seth Robertson, Boston, MA (US)

(73) Assignee: Force SV, LLC, Fairfax, VA (US)

( * ) Notice: Subject to any disclaimer, the term of this patent is extended or adjusted under 35 U.S.C. 154(b) by 38 days.

(21) Appl. No.: 15/529,262

(22) PCT Filed: Nov. 24, 2015

(86) PCT No.: PCT/US2015/062536
§ 371 (c)(1),
(2) Date: May 24, 2017

(87) PCT Pub. No.: WO2016/086068
PCT Pub. Date: Jun. 2, 2016

(65) Prior Publication Data

US 2017/0259098 A1 Sep. 14, 2017

Related U.S. Application Data

(60) Provisional application No. 62/083,596, filed on Nov. 24, 2014.

(51) Int. Cl.

| | |
|---|---|
| ***A62C 99/00*** | (2010.01) |
| ***A62C 2/00*** | (2006.01) |
| ***A62C 3/00*** | (2006.01) |
| ***G10K 9/22*** | (2006.01) |
| ***G10K 11/26*** | (2006.01) |
| ***G10K 11/30*** | (2006.01) |

(52) U.S. Cl.
CPC ..... *A62C 99/009* (2013.01); *A62C 2/00* (2013.01); *A62C 3/00* (2013.01); *G10K 9/22* (2013.01); *G10K 11/26* (2013.01); *G10K 11/30* (2013.01)

(58) Field of Classification Search
CPC ..... A62C 99/009; A62C 2/00; A62C 3/00; G01K 9/22; G01K 11/26; G01K 11/30; G10K 9/22; G10K 11/26; G10K 11/30
USPC ..... 169/43, 45, 46, 54, 70
See application file for complete search history.

(56) References Cited

U.S. PATENT DOCUMENTS

| | | | |
|---|---|---|---|
| 3,540,544 | A | 11/1970 | Karlson |
| 3,879,673 | A | 4/1975 | Shaw |
| 4,003,518 | A | 1/1977 | Hori et al. |
| 4,735,282 | A | 4/1988 | Lippold |
| 5,166,698 | A | 11/1992 | Ashbaugh et al. |
| 5,307,516 | A | 4/1994 | Nomoto |

(Continued)

OTHER PUBLICATIONS

DARPA-13-F-1078. Darpa Instant Flame Suppression, Phase II Final Report: Acoustic Waves: Harvard University, 2008. Print.

(Continued)

*Primary Examiner* — Steven J Ganey
(74) *Attorney, Agent, or Firm* — BakerHostetler

(57) ABSTRACT

Methods, systems, and devices for disrupting phenomena are disclosed. An example device can comprise a transducer configured to receive a signal and output a longitudinal wave based on the signal. The example device can comprise a wave enhancer coupled to the transducer and configured to direct the longitudinal wave into a form having lower attenuation in a medium than the longitudinal wave as output from the transducer.

36 Claims, 11 Drawing Sheets

(56) References Cited

U.S. PATENT DOCUMENTS

| | | | | |
|---|---|---|---|---|
| 5,899,685 | A | 5/1999 | Thigpen | |
| 6,104,301 | A | 8/2000 | Golden | |
| 6,907,786 | B1 | 6/2005 | Gebhardt et al. | |
| 2005/0004457 | A1 | 1/2005 | Moilanen et al. | |
| 2006/0196681 | A1 | 9/2006 | Adiga et al. | |
| 2007/0172801 | A1* | 7/2007 | Darois | G09B 19/00 434/226 |
| 2010/0203460 | A1 | 8/2010 | Formigoni | |
| 2012/0308050 | A1 | 12/2012 | Botti et al. | |
| 2013/0312429 | A1 | 11/2013 | Greuet et al. | |

OTHER PUBLICATIONS

Plaks, D., Nelson, E., Hyatt, N. and Espinosa, J. Zero-G acoustic fire suppression system, Abstract, Journal of the Acoustical Society of America, 118, (2005).

Nishitani, C., & Collins, G. (n.d.). Sound Extinguisher. Accessed Aug. 23, 2017, <tuhsphysics.ttsd.k12.or.us/Research/IB08/NishColl/index.htm>.

Snyder, Alison. "When Fire Strikes, Stop, Drop and . . . Sing?" Scientific American, Published Jan. 24, 2008, <www.scientificamerican.com/article/when-fire-strikes-stop-drop-and-sing/>.

Defense Advanced Research Projects Agency. "To extinguish a hot flame, scientists studied cold plasma." ScienceDaily. ScienceDaily, Published Jul. 12, 2012. <www.sciencedaily.com/releases/2012/07/120712141924.htm>.

The Physics Classroom (n.d.). Sound is a Mechanical Wave. Available Jul. 16, 2014, <www.physicsclassroom.com/Class/sound/u11l1a.cfm>.

National Aeronautics and Space Administration (n.d.).Combustion. Available Feb. 27, 2014, <www.grc.nasa.gov/WWW/K-12/airplane/combst1.html>.

John Tyndall, Wikipedia.org, Available Oct. 14, 2014, <en.wikipedia.org/wiki/John_Tyndall>.

Mikedi, K., et al. A, Chemical, acoustic and optical response profiling for analysing burning patterns. Sensors and Actuators, (176), 290-298, Jan. 2013.

Yano, T., Takahashi, K., Kuwahara, T., & Tanabe, M., Influence of Acoustic Perturbation and Acoustically Induced Thermal Convection on Premixed Flame Propagation. Microgravity Science and Technology, (22), 155-161, Dec. 4, 2009, doi:10.1007/s12217-009-9169-x.

Vortex ring—Wikipedia, the free encyclopedia. (n.d.). Available Oct. 12, 2014, <en.wikipedia.org/wiki/Vortex_ring>.

Rogoff, G., Plasma and Flames—The Burning Question. Coalition for Plasma Science. 2008, <www.plasmacoalition.org/plasma_writeups/flame.pdf>.

NDT Resource Center (n.d.). Radiated Fields of Ultrasonic Transducers. Available Sep. 4, 2014, <www.ndt-ed.org/EducationResources/CommunityCollege/Ultrasonics/EquipmentTrans/radiatedfields.htm>.

Pawela, B. The Chemistry of Fire, Available Nov. 14, 2009, <mypages.iit.edu/~smart/pawebar/lesson3.html>.

DARPA Demos Acoustic Suppression of Flame, Darpatv Youtube Channel, Jul. 12, 2012, <www.youtube.com/watch?v=DanOeC2EpeA>.

Soundwaves: A new principle in fire suppression, IFSEC Global, Jul. 17, 2012, <www.ifsecglobal.com/soundwaves-a-new-principle-in-fire-suppression/>.

Bausch, J. Darpa uses electromagnetics, acoustics to put out fires, Electronic Products, Jul. 23, 2012, <www.electronicproducts.com/News/DARPA_uses_electromagnetics_acoustics_to_put_out_fires.aspx>.

International Search Report from PCT/US2015/062536; dated Mar. 10, 2016.

Plaks, Dmitriy, "Sound Waves: Untapped Fire Extinguishers," Abstract of Presentation on Oct. 19, 2005. <http://acoustics.org/pressroom/httpdocs/150th/Plaks.html>.

The Tonight Show Staring Jimmy Fallon, "Kevin Delaney Explodes Ping Pong Balls," Published Jun. 8, 2015 <https://youtu.be/CMpIxEE4xdo>.

"Sound Wave Fire Extinguisher | The Henry Ford's Innovation Nation," Published Mar. 30, 2016, <https://youtu.be/vycNvJYsc6U>.

Ripley's Believe it or Not, "George Mason Students Invent a Soundwave Fire Extinguisher," Published Aug. 26, 2016, < https://www.ripleys.com/weird-news/sound-wave-tire-extinguisher/>.

Interesting Engineering, "Two Engineering Students Invent a Sonic Fire Extinguisher," Published Jan. 13, 2017, <https://interestingengineering.com/two-engineering-students-invent-a-sonic-fire-extinguisher>.

Time Magazine, "Watch Two Students Extinguish Fire Using Sound," Published Mar. 26, 2015, <https://time.com/3760361/students-extinguish-fire-with-sound/>.

The Washington Post, "When it comes to putting out fire, GMU students show it's all about that bass," Published Mar. 22, 2015, <https://www.washingtonpost.com/local/when-it-comes-to-putting-out-fire-gmu-students-show-its-all-about-that-bass/2015/03/22/47a7f8e8-cf1a-11e4-a2a7-9517a3a70506_story.html?utm_term=.5cd6264b6f6a>.

Vocativ, "This Fire Extinguisher Uses Sound Waves to Put Out Fire," Published Mar. 27, 2015, <https://www.youtube.com/watch?v=6znIZE3MkW4&feature=youtu.be>.

Global1 News Network, <https://youtu.be/d48Ww6AcMWc>.

Nerd Alert, "Sound Fire Extinguisher Drops the Bass to Put Out Flames," Published Apr. 14, 2015, <https://youtu.be/cSX9eR8Mles>.

Calder Greenwood, "Audio Engineer Makes Weapon Using Dubstep," Published Apr. 14, 2015, <https://youtu.be/EDMeFI5bB0I>.

M. Bae and E. Yi, "On a fire extinguisher using sound winds," The Journal of the Acoustical Society of America 140, 2958 (2016).

PARAS RANAvalsad, "Fire extinguisher using Acoustic waves," Published Feb. 10, 2019, <https://www.youtube.com/watch?v=XTmK903x9sA>.

Geojovin, "Smart Acoustic Fire Extinguisher," Published Jul. 4, 2016, <https://www.youtube.com/watch?v=qircwd8a2XQ&feature=youtu.be>.

* cited by examiner

METHODS AND SYSTEMS FOR DISRUPTING PHENOMENA WITH WAVES

CROSS REFERENCE TO RELATED PATENT APPLICATION

This application is a National Stage of International Patent Application No. PCT/US2015/062536, filed Nov. 24, 2015, entitled "Methods and Systems for Disrupting Phenomena with Waves" and claims priority to U.S. Provisional Application No. 62/083,596, filed Nov. 24, 2014, herein incorporated by reference in their entirety.

BACKGROUND

Firefighting typically involves the use of chemical or liquids to extinguish flames. These chemicals can be costly and may damage the environment. These liquids and chemicals can also be very difficult to transport to the scene of a fire and be depleted very quickly. Thus, there is a need for more sophisticated ways for disputing chemical reactions, such as fires.

SUMMARY

It is to be understood that both the following general description and the following detailed description are exemplary and explanatory only and are not restrictive, as claimed. Provided are methods and systems for disrupting phenomena. An example device can comprise a transducer configured to receive a signal and output a longitudinal wave based on the signal. The example device can comprise a wave enhancer coupled to the transducer and configured to direct the longitudinal wave into a form having lower attenuation in a medium than the longitudinal wave as output from the transducer.

In an aspect, another example device can comprise a transducer configured to receive a signal and output a longitudinal wave based on the signal and a chamber comprising an inlet coupled to the transducer. The chamber can comprise an outlet and can be configured to direct the longitudinal wave along an axis of the chamber extending from the inlet to the outlet. The chamber can be configured to modify the longitudinal wave into a form having lower attenuation in a medium than the longitudinal wave as output from the transducer.

In another aspect, an example method can comprise receiving a signal, providing the signal to a transducer configured to output a longitudinal wave based on the signal, and enhancing the longitudinal wave into a form having lower attenuation in a medium than the longitudinal wave as output from the transducer.

Additional advantages will be set forth in part in the description which follows or may be learned by practice. The advantages will be realized and attained by means of the elements and combinations particularly pointed out in the appended claims.

BRIEF DESCRIPTION OF THE DRAWINGS

The accompanying drawings, which are incorporated in and constitute a part of this specification, illustrate embodiments and together with the description, serve to explain the principles of the methods and systems.

DETAILED DESCRIPTION

Figure 1:
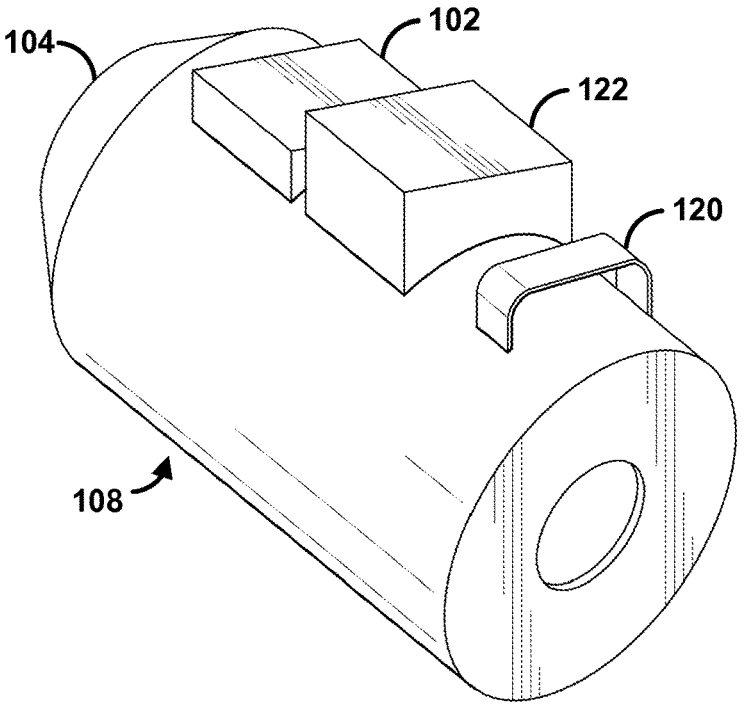
FIG. 1 is a perspective view illustrating an example device for disrupting phenomena.

Before the present methods and systems are disclosed and described, it is to be understood that the methods and systems are not limited to specific methods, specific components, or to particular implementations. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and systems may be understood more readily by reference to the following detailed description of preferred embodiments and the examples included therein and to the Figures and their previous and following description.

As will be appreciated by one skilled in the art, the methods and systems may take the form of an entirely hardware embodiment, an entirely software embodiment, or an embodiment combining software and hardware aspects. Furthermore, the methods and systems may take the form of a computer program product on a computer-readable storage medium having computer-readable program instructions (e.g., computer software) embodied in the storage medium. More particularly, the present methods and systems may take the form of web-implemented computer software. Any suitable computer-readable storage medium may be utilized including hard disks, CD-ROMs, optical storage devices, or magnetic storage devices.

Embodiments of the methods and systems are described below with reference to block diagrams and flowchart illustrations of methods, systems, apparatuses and computer program products. It will be understood that each block of the block diagrams and flowchart illustrations, and combinations of blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create a means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including computer-readable instructions for implementing the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions.

The present disclosure relates to method, systems, and a device for disrupting chemical reactions and other phenomena. Specifically, the present disclosure relates to the use of waves, including longitudinal waves, such as pressure waves (e.g., acoustic waves) to disrupt chemical reactions, such as fires.

In an aspect, fire suppressing technology can pose many dangers to the equipment and surrounding personnel. The present methods and systems can be configured to suppress and extinguish flames with acoustic waves. The present methods and systems can be configured to extinguish fires without the use of harmful chemicals that are used in traditional extinguishing methods. Current fire extinguishing technology leaves a residue and a mess after the extinguisher has been used. The chemical foam/powder increases the potential for further damage and cleanup. The present methods and systems also do not require "refilling" of chemicals as with a typical extinguisher. Current extinguishers need to be replaced due to the expiration of the chemicals. The present methods and systems can be applied ubiquitously in automobiles, vehicles, trains, spacecraft, watercraft, and in any location where there is a potential for a fire. Spacecraft can benefit enormously by the all-around advantages the present methods and systems. Current use of Halon 1301 poses danger to on-flight personnel and valuable equipment. The present methods and systems revolutionize fire suppressing technology and assure a higher level of safety to the user. As an example, the present methods and systems can be configured to suppress and extinguish alcohol (e.g., isopropyl alcohol) flames. In an aspect, the present methods and systems can be configured to provide acoustic waves in the low frequency range (e.g., 20 Hz-160 Hz) to suppress flames. The present methods and systems can be configured to use the vortex ring phenomenon to focus acoustic power to suppress a flame.

As a further example, the present methods and systems can comprise a tone generator, audio amplifier, power supply unit, collimator, subwoofer speaker, vortex nozzle, and/or the like. An example tone generator can be configured to produce a desired tone frequency, such as a frequency between 20 Hz-160 Hz. An example audio amplifier can receive an audio frequency input and amplifies the signal input into the subwoofer. An example power supply unit can be configured to power the audio amplifier. An example collimator can comprise a cylindrical shaped component that narrows and focuses the sound in a chosen direction. An example subwoofer speaker can be configured to produce the low frequency acoustic waves. An example, vortex nozzle can be disposed at the end tip of the collimator to narrow and focus the acoustic waves.

Figure 2:
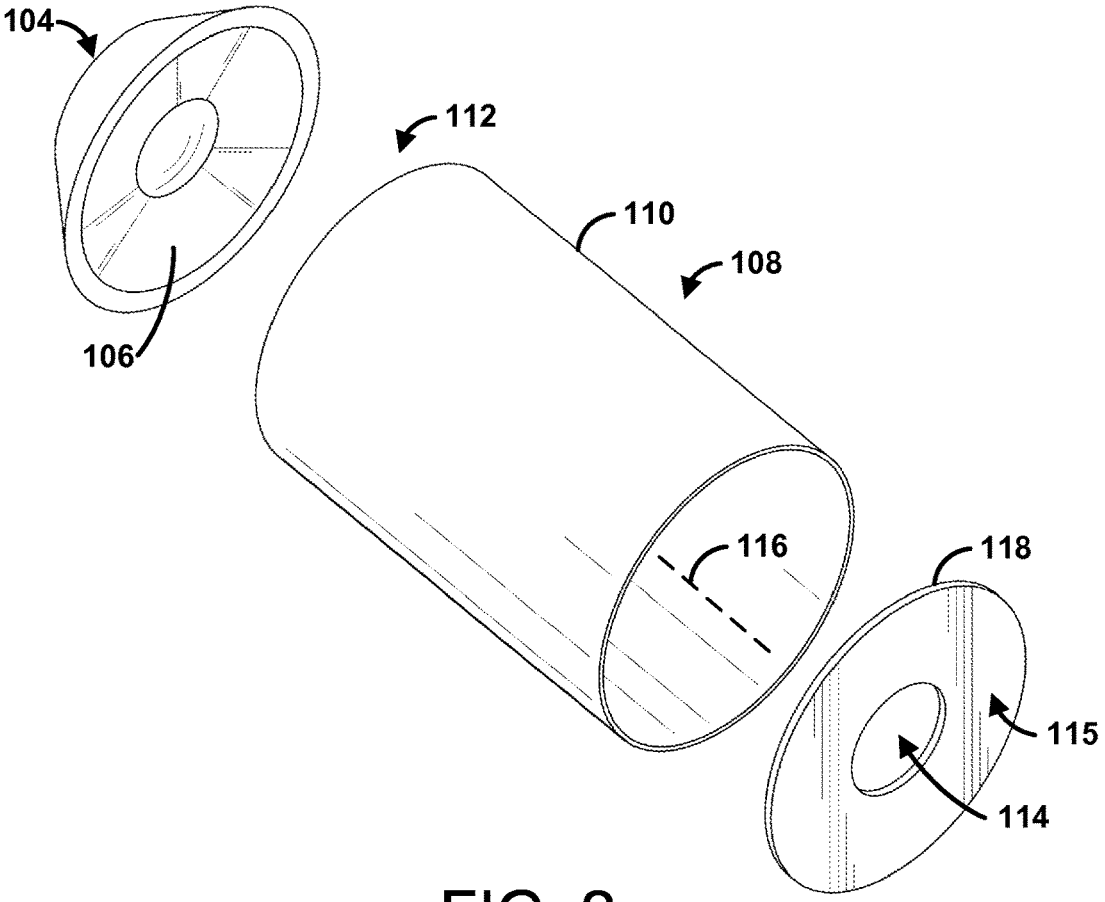
FIG. 2 is another perspective view illustrating an example apparatus for disrupting phenomena.

FIG. 1 and FIG. 2 are perspective views illustrating an example device 100 for disrupting phenomena. In an aspect, the device 100 can comprise a control unit 102. The control unit 102 can be configured to control operations of the device 100. For example, the control unit 102 can comprise a computing device and/or an integrated circuit. The control unit 102 can comprise a processor, such as a microcontroller. The control unit 102 can comprise a wireless radio configured to communicate with one or more remote devices. The control unit 102 can comprise storage. The storage can comprise volatile and/or non-volatile memory. The control unit 102 can comprise a display for receiving input from and/or providing output to a user. The control unit 102 can be configured to receive information and/or providing information to a remote device. The remote device can comprise a mobile device (e.g., smart phone, smart watch, smart glasses, smart apparel), a server, a charging station, a portable computer, a computer station, and/or the like. For example, an application on the remote device can be configured to communicate with an application on the control unit 102.

The control unit 102 can comprise a signal generator. The signal generator can be configured to generate a signal, such as an electronic signal. For example, the signal generator can comprise a modulator, encoder, signal generation software, an integrated circuit configured to generate signals (e.g., an ASCI, FPGA), and/or the like. For example, the control unit 102 can store one or more signal files (e.g., encoded data). The signal generator can be configured to convert the one or more signal files to generate the signal. In another aspect, the signal generator can comprise digital and/or analog circuitry configured to generate the signals (e.g., upon receiving power). The signal can comprise a tone. In an aspect, the signal can comprise an oscillating signal. For example, the signal can comprise sinusoidal waves, triangle waves, square waves, a combination thereof, and/or the like. For example, the signal can oscillate at a frequency. The frequency can be configured to (e.g., selected to) disrupt physical phenomena, such as a chemical reaction. For example, the frequency can be configured to disrupt a fire and/or flame (e.g., using a longitudinal wave).

The signal can be configured (e.g., selected, programmed) to cause a wave generated based on the signal (e.g., a longitudinal wave) to oscillate such that a fuel source of a chemical reaction receiving the wave is disrupted thereby reducing or stopping the chemical reaction. For example, the frequency can be configured to cause the wave to disrupt a fire. In an aspect, the frequency and/or other features of the signal can be selected based a characteristic of the chemical reaction. For example, the frequency can be based on a frequency associated with the chemical reaction. The materials involved in the chemical reaction can have different properties, such as different reaction frequencies. In an aspect, the frequency associated with the chemical reaction can be based on a class of the chemical reaction, such as a fire class. As an example, Class A fires can comprise ordinary combustibles, such as wood, paper, fabric, and most kinds of trash. Class B fires can comprise fires of a flammable and/or combustible liquid and/or gas. Class C fires can comprise fires of energized electrical equipment. Class D fires can comprise combustible metals, such as alkali metals (e.g., lithium and potassium), alkaline earth metals (e.g., magnesium), group 4 elements (e.g., titanium, zirconium), and/or the like. Class K fires can comprise unsaturated cooking oils. One or more of the classes of chemical reactions can have an associated reaction frequency (e.g., frequency at which combustion occurs). The frequency of the signal generator can be selected based on which fire class is associated with a fire a user is attempting to disrupt. For example, the device 100 can comprise one or more sensors configured to detect the materials of a chemical reaction (e.g., fire). The one or more sensors can comprise, an infrared sensor, temperature sensor, frequency sensor (e.g., detecting frequency of the chemical reaction). The frequency generator can automatically select the appropriate frequency based on the detected materials. In another aspect, a user can manually select the frequency (e.g., via a button, a menu, a switch). In some implementations, the signal generator 102 can be configured to generate the signal by alternating between different frequencies (e.g., in case multiple classes of materials are involved in the chemical reaction and/or if the materials are unknown).

As an example, the frequency can be within a range of about 20 Hz to about 160 Hz, including exemplary subranges of about 20 Hz to about 30 Hz, about 20 Hz to about 40 Hz, about 20 Hz to about 50 Hz, about 20 Hz to about 60 Hz, about 20 Hz to about 70 Hz, about 20 Hz to about 80 Hz, about 20 Hz to about 90 Hz, about 20 Hz to about 100 Hz, about 20 Hz to about 110 Hz, about 20 Hz to about 120 Hz, about 20 Hz to about 130 Hz, about 20 Hz to about 140 Hz, about 20 Hz to about 150 Hz, about 30 Hz to about 40 Hz, about 30 Hz to about 50 Hz, about 30 Hz to about 60 Hz, about 30 Hz to about 70 Hz, about 30 Hz to about 80 Hz, about 30 Hz to about 90 Hz, about 30 Hz to about 100 Hz, about 30 Hz to about 110 Hz, about 30 Hz to about 120 Hz, about 30 Hz to about 130 Hz, about 30 Hz to about 140 Hz, about 30 Hz to about 150 Hz, about 30 Hz to about 160 Hz, about 40 Hz to about 50 Hz, about 40 Hz to about 60 Hz, about 40 Hz to about 70 Hz, about 40 Hz to about 80 Hz, about 40 Hz to about 90 Hz, about 40 Hz to about 100 Hz, about 40 Hz to about 110 Hz, about 40 Hz to about 120 Hz, about 40 Hz to about 130 Hz, about 40 Hz to about 140 Hz, about 40 Hz to about 150 Hz, about 40 Hz to about 160 Hz, about 50 Hz to about 60 Hz, about 50 Hz to about 70 Hz, about 50 Hz to about 80 Hz, about 50 Hz to about 90 Hz, about 50 Hz to about 100 Hz, about 50 Hz to about 110 Hz, about 50 Hz to about 120 Hz, about 50 Hz to about 130 Hz, about 50 Hz to about 140 Hz, about 50 Hz to about 150 Hz, about 50 Hz to about 160 Hz, about 60 Hz to about 70 Hz, about 60 Hz to about 80 Hz, about 60 Hz to about 90 Hz, about 60 Hz to about 100 Hz, about 60 Hz to about 110 Hz, about 60 Hz to about 120 Hz, about 60 Hz to about 130 Hz, about 60 Hz to about 140 Hz, about 60 Hz to about 150 Hz, about 60 Hz to about 160 Hz, about 70 Hz to about 80 Hz, about 70 Hz to about 90 Hz, about 70 Hz to about 100 Hz, about 70 Hz to about 110 Hz, about 70 Hz to about 120 Hz, about 70 Hz to about 130 Hz, about 70 Hz to about 140 Hz, about 70 Hz to about 150 Hz, about 70 Hz to about 160 Hz, about 80 Hz to about 90 Hz, about 80 Hz to about 100 Hz, about 80 Hz to about 110 Hz, about 80 Hz to about 120 Hz, about 80 Hz to about 130 Hz, about 80 Hz to about 140 Hz, about 80 Hz to about 150 Hz, about 80 Hz to about 160 Hz, about 90 Hz to about 100 Hz, about 90 Hz to about 110 Hz, about 90 Hz to about 120 Hz, about 90 Hz to about 130 Hz, about 90 Hz to about 140 Hz, about 90 Hz to about 150 Hz, about 90 Hz to about 160 Hz, about 100 Hz to about 110 Hz, about 100 Hz to about 120 Hz, about 100 Hz to about 130 Hz, about 100 Hz to about 140 Hz, about 100 Hz to about 150 Hz, about 100 Hz to about 160 Hz, about 110 Hz to about 120 Hz, about 110 Hz to about 130 Hz, about 110 Hz to about 140 Hz, about 110 Hz to about 150 Hz, about 110 Hz to about 160 Hz, about 120 Hz to about 130 Hz, about 120 Hz to about 140 Hz, about 120 Hz to about 150 Hz, about 120 Hz to about 160 Hz, about 130 Hz to about 140

Hz, about 130 Hz to about 150 Hz, about 130 Hz to about 160 Hz, about 140 Hz to about 150 Hz, about 140 Hz to about 160 Hz, and/or about 150 Hz to about 160 Hz. As another example, the frequency can be within other ranges, such as within the ultrasound range (e.g., from about 20 kHz to about 20 MHz). As an example, the frequency can be within a range, such as from about 20 KHz to about 30 KHz, from about 20 kHz to about 25 kHz, from about 25 kHz to about 30 kHz, from about 30 kHz to about 35 kHz, from about 35 kHz to about 40 kHz, from about or 37 kHz to about 39 kHz. As an example the frequency can be about 35 KHz, 36 KHz, 37 KHz, 38 KHz, 39 KHz, 40 KHz, 41 KHz, and/or the like.

In an aspect, the control unit 102 can comprise an amplifier. The amplifier can be communicatively coupled (e.g., electrically coupled) to the signal generator. The amplifier can be configured to amplify the signal. For example, the amplifier can be configured to increase the amplitude of the signal. The amplifier can receive the signal from the signal generator. The amplifier can output an amplified signal based on the signal.

In an aspect, the device 100 can comprise a transducer 104. The transducer 104 can be configured to receive the signal (e.g., or amplified signal). For example, the transducer 104 can be communicatively coupled (e.g., electrically coupled) to the signal generator and/or the amplifier.

The transducer 104 can be configured to receive the signal from the signal generator 102 and output (e.g., generate) a wave based on the signal. The transducer 106 can be configured to output the wave in a vacuum or within an atmosphere (e.g., air, medium comprising a plurality of molecules). For example, the wave can comprise a transverse wave and/or a longitudinal wave. The longitudinal wave can comprise a pressure wave, such as an acoustic wave. The wave can comprise an electromagnetic wave, such as a transverse electromagnetic wave and/or a longitudinal electromagnetic wave.

In an aspect, the transducer 104 can be any device configured to generate the wave based on the signal. For example, the transducer 104 can comprise a piston (e.g., mechanical arm, cylinder) that moves in response to the signal. The transducer 104 can comprise an audio speaker. For example, the transducer 104 can comprise a subwoofer. The transducer 104 can comprise a diaphragm 106, such a cone shape diaphragm, a flat diaphragm, and/or the like. In some implementations, the transducer 104 can comprise a plate, such as flat plate (e.g., in addition to or instead of the diaphragm 106). The transducer 104 can comprise a motor (e.g., mechanical, magnetic) configured to move the diagram 106 to generate the wave. The transducer 104 can comprise a solenoid driver, solenoid valve, an air source (e.g., compressed air source). The transducer 104 can comprise one or more pneumatic components, such as an air motor, pneumatic cylinder, and/or the like. For example, the transducer 104 can comprise a compressor (e.g., air compressor). For example, the transducer 104 can receive the signal (e.g., or amplified signal) and cause the diaphragm to oscillate according to the frequency of the signal. The motor, solenoid driver, and/or the like can be produce positive and/or negative pressure (e.g., in the pneumatic system) thereby causing movement of the diaphragm. The movement of the diaphragm 106 can cause components (e.g., molecules) of a medium (e.g., air, gas molecules) to move in a direction. For example, the transducer 104 can cause alternating compressions and rarefactions in the medium. The compressions and rarefactions can be spaced such that the fuel of the chemical reaction is disrupted (e.g., air is moved away from a fire), thereby diminishing and/or stopping the chemical reaction. For example, the wave can thin, disperse, disrupt, and/or the like a boundary layer of the chemical reaction.

In an aspect, the device 100 can comprise a wave enhancer 108. The wave enhancer 108 can be coupled to (e.g., mechanically coupled, affixed, attached, extend from) the transducer 104. The wave enhancer 108 can be configured to direct the wave into a form having lower attenuation in the medium than the wave as output from the transducer 104. The wave enhancer 108 can be made of a material having acoustic stability at for low frequencies (e.g., 20 Hz-160 Hz). Example materials can comprise Aluminum, steel (e.g., light-weight steel), Titanium, Carbon Fiber, Kevlar, Glass, Fiberglass, plastic (e.g., heat-resistant plastic), and/or the like.

In an aspect, the wave enhancer 108 can comprise a chamber 110 (e.g., hollow chamber, housing, conduit, tube, tunnel, pipe, duct, channel). The chamber 110 can be shaped as a cylinder, rectangular prism, triangular prism, a other shaped prism, and/or the like. The chamber 110 can be spherical. For example, the transducer 104 can be disposed within a spherical chamber comprising one or more outlets. For example, the outlets can be disposed in a pattern around the spherical chamber, such as every X degrees (e.g., 30, 45, 60, 90, 180 degrees), equally spaced (e.g., along one or more axis). The chamber 110 can have any other shape that optimizes (e.g., maximizes, increases) wave (e.g., acoustic wave) acceleration, velocity, and/or the like (e.g., thereby increasing distance traveled by the wave in the medium). For example, the chamber 110 can comprise telescopic structures, funnel-shaped structures, and/or the like as discussed further herein. The wave enhancer 108 can comprise an inlet 112. The inlet 112 can be coupled to the transducer 104. The wave enhancer 108 can comprise an outlet 114.

The chamber 110 can be a collimator. Though only one chamber 110 is shown, it is contemplated that the wave enhancer 108 can comprise multiple chambers 110 in parallel and/or in series. For example, the chamber 110 can be configured to align the longitudinal wave along a path directed by the chamber 110. The chamber 110 can be configured to direct the wave along an axis 116 of the chamber 110 extending from the inlet 112 to the outlet 114. The chamber 110 can be configured to modify the wave into a form having lower attenuation in a medium than the wave as output (e.g., received) from the transducer 104. Attenuation is the loss of strength of a signal as the signal travels through a medium. Thus, for a wave to have lower attenuation in the medium means that the wave can travel a greater distance through a medium (e.g., due to increased velocity, internal rotations, decreased friction with the medium) and/or the wave can maintain a stronger signal strength (e.g., for a particular distance, for a longer distance).

The wave enhancer 108 can be configured to align the wave along the axis 116 of a chamber 110 (e.g., axis of the wave enhancer 108). The chamber 110 can be an elongated chamber (e.g., having a length greater than a width). The outlet 114 can be configured to cause at least a portion of the wave to rotate as the wave travels away from (e.g., out of the) the wave enhancer 108, chamber 110, and/or outlet 114. The rotation can be around an axis formed as a closed loop. For example, the outlet 114 can form the wave (e.g., or a portion thereof) into a vortex ring. The axis can be an axis of the vortex ring (e.g., around which air rotates in a ring shape). As the signal may be continuous (e.g., or substantially continuous as a digital signal), the wave can form a continuum of successive vortex rings. The wave can form a channel in the medium based on one or more vortex rings.

For example, the rotation can be caused by channeling a jet stream into a medium. The medium can have a relatively slow velocity in comparison to the jet stream. The jet stream can rotate (e.g., in the form of a vortex ring) as the jet stream interfaces with (e.g., collides with, pushes against) the medium.

The wave enhancer 108 can be configured to increase a velocity of at least a portion of the wave. The velocity can be increased by channeling the wave along the chamber 110. The velocity can be increased by channeling the wave though an outlet 114 narrower than the chamber 110. For example, the outlet 114 can comprise a nozzle. In an aspect, the wave enhancer 108 can be configured to channel the wave through a chamber from the inlet 112 of the chamber 110 to an outlet 114 of the chamber 110. The wave can exit the wave chamber 110 through the outlet 110. The outlet 110 can be smaller than the inlet 112. In another aspect, the inlet 112 can be smaller than the outlet 110.

Figure 4A:
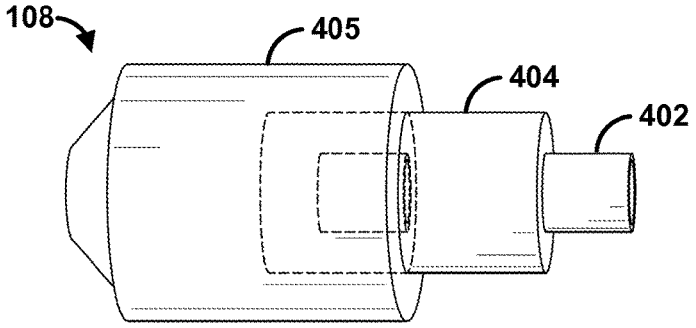
FIG. 4A illustrates an example telescoping wave enhancer.

In an aspect, the wave enhancer 108 can be tunable to cause resonation of the wave within the wave enhancer 108. For example, the wave enhancer 108 (e.g., chamber 110) can be expanded, contracted, and/or decreased in length. The wave enhancer 108 can, for example, comprise a plurality of sections that are removable Removal or addition of a section can increase the length and/or size of the wave enhancer 108. The wave enhancer 108 can be expanded and/or contracted by the application of heat and/or removal of heat (e.g., via a cooling element). As shown in FIG. 4A, the wave enhancer 108 can comprise collapsible portions for extending or reducing the length of the wave enhancer 108.

Figure 9:
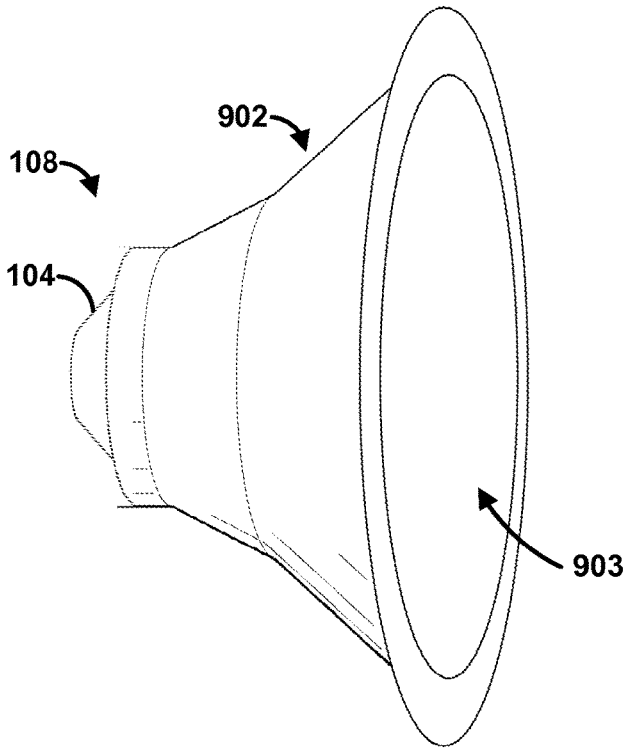
FIG. 9 illustrates an example wave enhancer comprising a cone shaped member.
Figure 10:
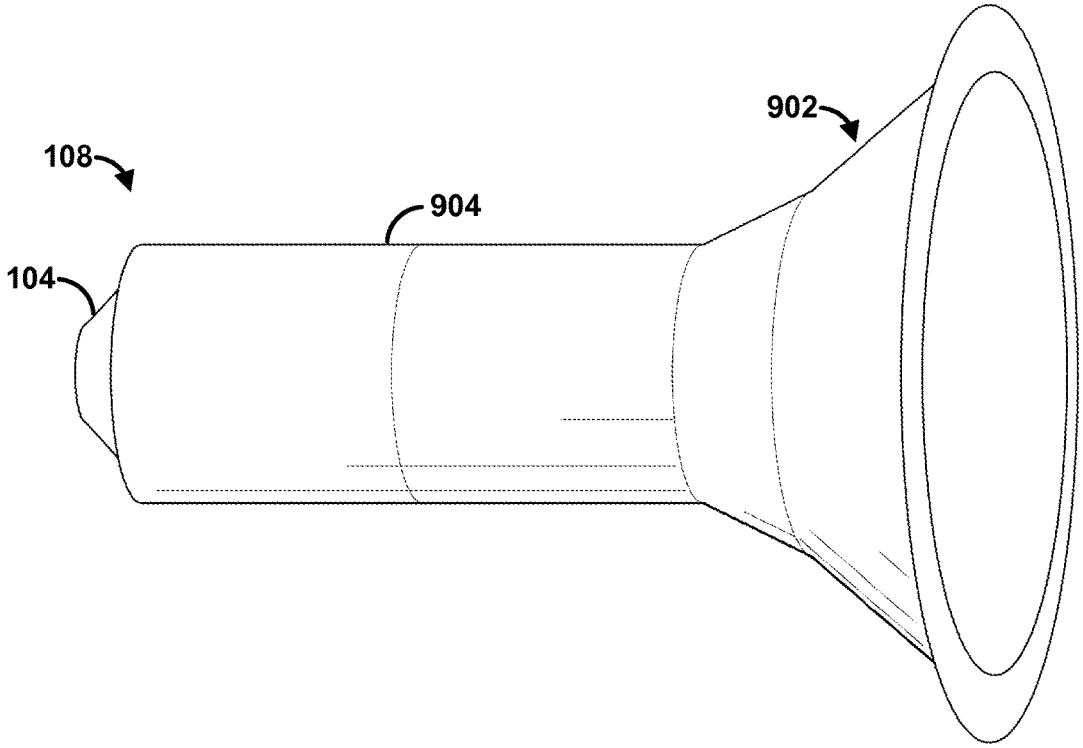
FIG. 10 illustrates another example wave enhancer comprising the cone shaped wave enhancer.
Figure 14:
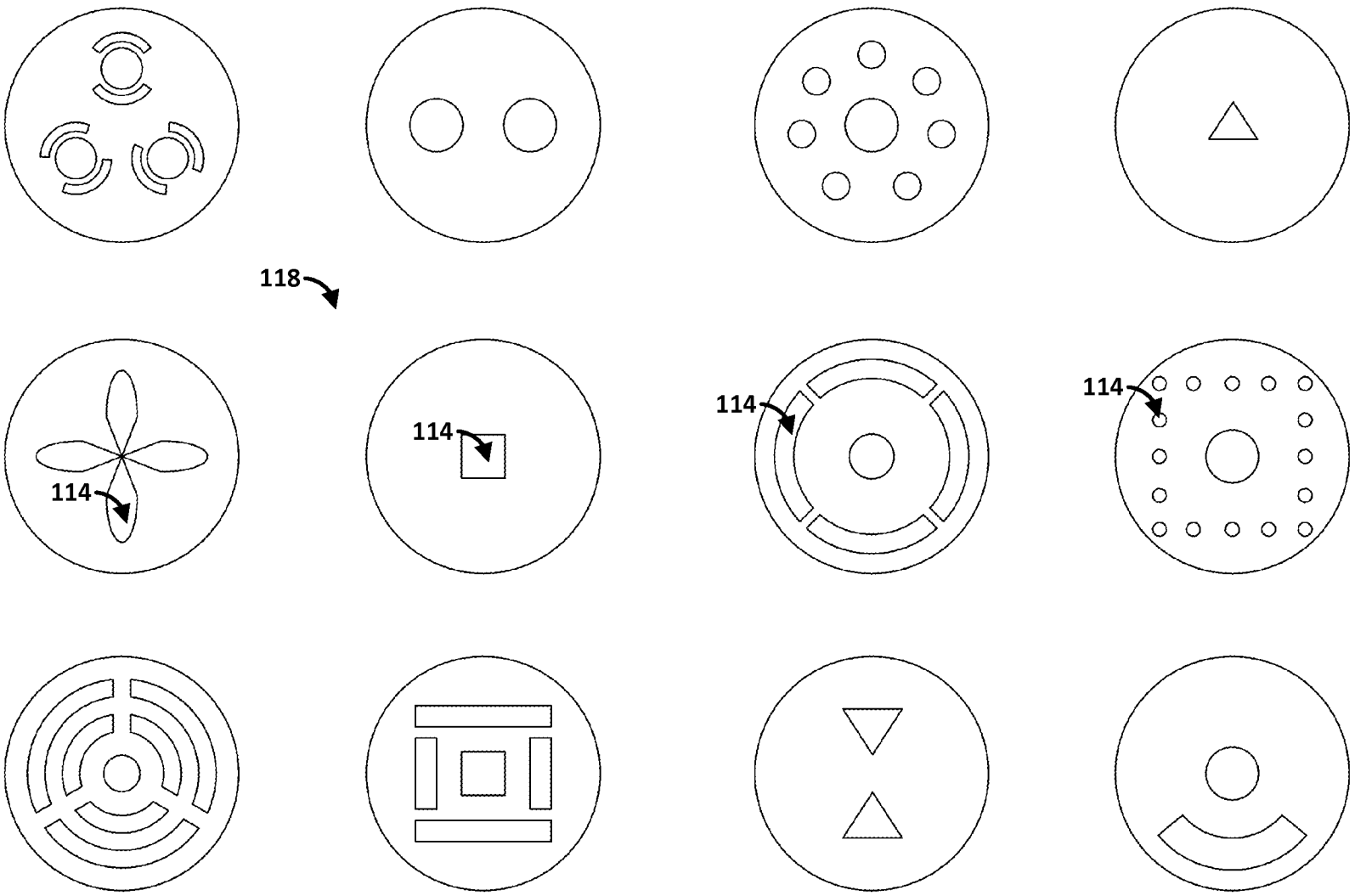
FIG. 14 illustrates a variety of example caps.

In an aspect, the wave enhancer 108 can be configured to focus the wave. The wave can be focused as the wave exits the outlet 110 of the chamber 110. For example, the wave enhancer 108 can be configured to channel the wave through at least two outlets 114 (e.g., as shown in FIG. 4D, FIG. 4E, and FIG. 14). The wave enhancer 108 can comprise curved walls configured to focus the wave as the wave exits the outlet. The wave enhancer 108 can comprise a cap 118. The cap 118 can comprise a plate 115. The plate can be round, square, rectangular, and/or the like. The plate 115 can comprise one or more openings, such as the outlet 114. In some implementations, the cap 118 can comprise, for example, a nozzle. The nozzle can taper from a larger cross-section to a smaller cross-section (e.g., thereby focusing the wave). For example, the nozzle can comprise a first opening and a second opening opposite the first opening. The second opening can be smaller than the first opening. In some implementations, the second opening can be larger than the first opening, as shown in FIG. 9 and FIG. 10. In an aspect, the cap 118 can be attached, to the chamber 110 using any adhesive (e.g., tape), straps, knobs, brackets, latches, hinges, ridges, screw-like attachments, a combination thereof, and/or the like. In some implementations, the cap 118 and chamber 110 can be formed as one chamber assembly. For example, the cap 118 can comprise a first end of the chamber 110. The first end of the chamber 110 can be flat and comprise a one or more opening, such as the outlet 114. The first end can be opposite a second end (e.g., comprising the inlet 112). The second end can be coupled to (e.g., attached to, comprise) the transducer 104.

Figure 18A:
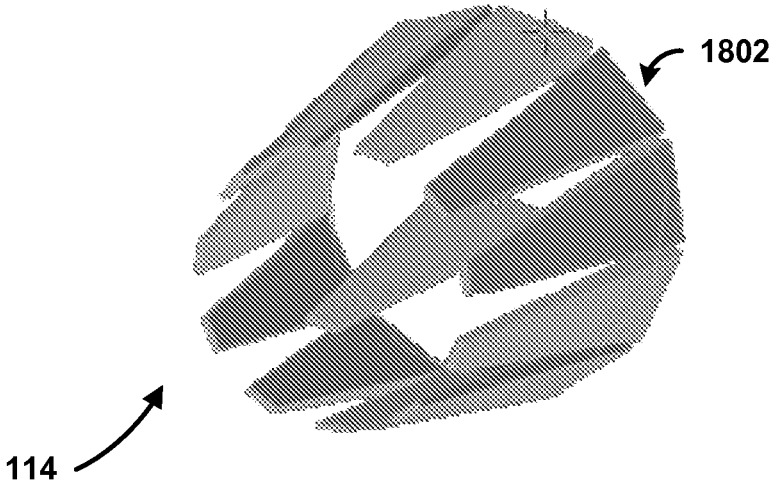
FIG. 18A illustrates an example adjustable outlet.
Figure 18B:
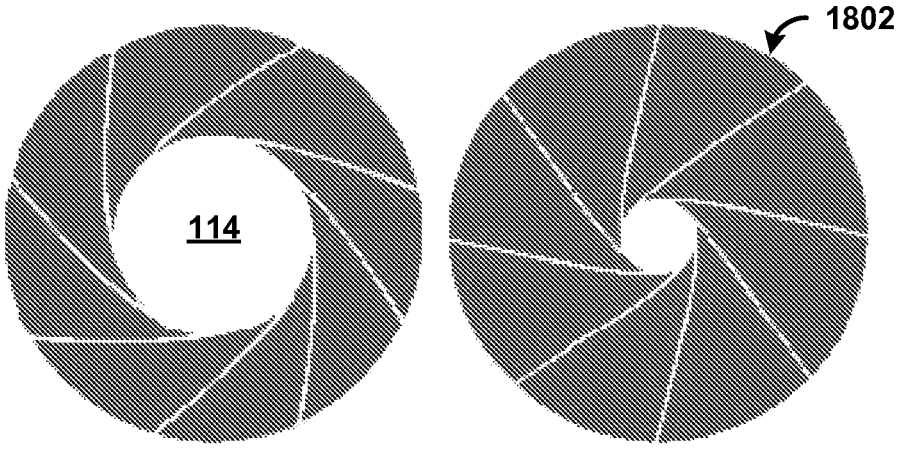
FIG. 18B illustrates a cross-sectional view of the example adjustable outlet.

In some implementations, the wave enhancer 108 (e.g., cap 120) can comprise an outlet having an adjustable size. For example, the outlet can be formed by a plurality nozzle elements (e.g., nozzle elements 1802 as shown in FIG. 18A and FIG. 18B). The plurality of nozzle elements can be triangular shaped, petal shaped, and/or the like. The plurality of nozzle elements can be moveable and/or overlapping. The plurality of nozzle elements can overlap such that a substantial circular outlet is formed. The outlet size may be adjusted by increasing and/or decreasing an amount of overlap between the plurality nozzle elements.

In an aspect, the device 100 can be stationary and/or portable. For example, the transducer 104 and the wave enhancer 108 can be portable. The system 100 can comprise a grip 120 extending from the wave enhancer 108. For example, the grip 120 can extend from an exterior wall of the chamber 110. As explained further herein (e.g., and as shown in FIG. 4A), the device 100 can be at least partially collapsible. For example, the wave enhancer 108 can be at least partial collapsible to decrease the length of the wave enhancer 108. The device 100 can be mounted to, incorporated into, and/or used within a vehicle, such as an aircraft (e.g., airplane, helicopter, drone), car, truck, watercraft, satellite, spacecraft. In an aspect, the device 100 can be deployed in a variety of scenarios and/or incorporated in to a variety of devices. The device 100 can be mounted to and/or mounted proximate to a fuselage (e.g. for putting out fires in the fuselage). For example, the device 100 can be deployed as part of a robotic technology (e.g., robotic firefighting system). For example, the device 100 can be deployed in a server farm. The device 100 can be used as and/or incorporated within firefighting technology. The device 100 can be mounted proximate to (e.g., above) a stove, cooktop, and/or the like. The device 100 can be mounted in a factory (e.g., near a laser cutting device). The device 100 can be mounted to vegetation, such as trees. The device 100 can be mounted to, incorporated into, and/or used within a residential and/or commercial property. For example, the device 100 can be (e.g., attached to walls, ceilings) used with or instead of a sprinkler system.

In an aspect, the device 100 can comprise a gas supply unit. The gas supply unit can comprise a gas canister coupled to the wave enhancer 108. The gas supply unit can be configured to cause the wave to carry gas provided by the gas canister. For example, the gas supply unit can provide gas from the gas canister into the chamber 110 (e.g., via a whole in the chamber 110). The gas can comprise a gas with chemical reaction suppressing properties (e.g., flame suppressing properties). The gas can comprise a gas that is incompatible with the chemical reaction. The gas may be unable to be used as a fuel source of the chemical reaction. For example, the gas can comprise one or more noble gases, such as helium, neon, argon, krypton, xenon, radon, element 118 (e.g., ununoctium), and/or the like. In an aspect, the gas supply unit can be attached to a user's back (e.g., similar to a fireman's air supply). In another aspect, the gas supply unit can be attached to an exterior wall of the wave enhancer 108 (e.g., chamber 110). The gas supply unit can be disposed within the control unit 102 and/or comprise a device separate from the chamber 110. The gas supply unit can be configured to generate gas. For example, the gas supply unit can be configured to separate molecules (e.g., separate nitrogen from oxygen) in a medium (e.g., air) and/or supply gas (e.g., the separated molecules) to the wave enhancer 108 (e.g., chamber 110).

In an aspect, the device 100 can comprise a cooling element configured to cause the longitudinal wave to carry cooled molecules. For example, a cooling element can be disposed within the chamber 110. As another example, the cooling element can be disposed outside the chamber 110. The cooling element can provide the cooled plurality of air molecules into the chamber (e.g., before and/or while the wave is generated by the transducer). The cooling element 110 can comprise a thermoelectric cooling element, such as a peltier cooling element. For example, the cooling element can use electrical energy to transfer heat out of an area (e.g., thereby cooling the area). For example, cooling element can comprise two materials of different electron densities, such as an n-type semiconductor and a p-type semiconductors. The two materials can be disposed thermally in parallel to each other and electrically in series. The two materials can be joined with a thermally conducting plate on each side. In some scenarios, the chamber walls can comprise the two materials. For example, the two materials can be disposed between an exterior wall and an interior wall of the chamber 110. The exterior wall and interior wall of the chamber 110 can comprise the thermally conducting plates. For example, the chamber 110 can be configured to draw heat out an interior of the chamber 110 and expel the heat outside the chamber 110.

In an aspect, the device 100 can comprise a power unit 122. The power unit 122 can be configured to provide power (e.g., voltage, current) to one or components of the device, such the control unit 102 (e.g., the signal generator, the amplifier), the transducer 104, the cooling element, and/or gas supply unit, the chamber 110, and/or the like. The power unit 122 can comprise a battery (e.g., rechargeable battery). The power unit 122 can be configured to receive power from a power outlet, a wireless power transmitter, and/or the like. The power can be provided from a battery. The power unit 122 can be configured to generate power based on an alternate energy source, such as light, water, wind, and/or the like. The power unit 122 can be configured to generate power based on energy released by the chemical reaction. For example, a the power unit 104 can comprise a thermoelectric generator configured to convert energy from the chemical reaction into an electrical current and/or electrical voltage.

Figure 3:
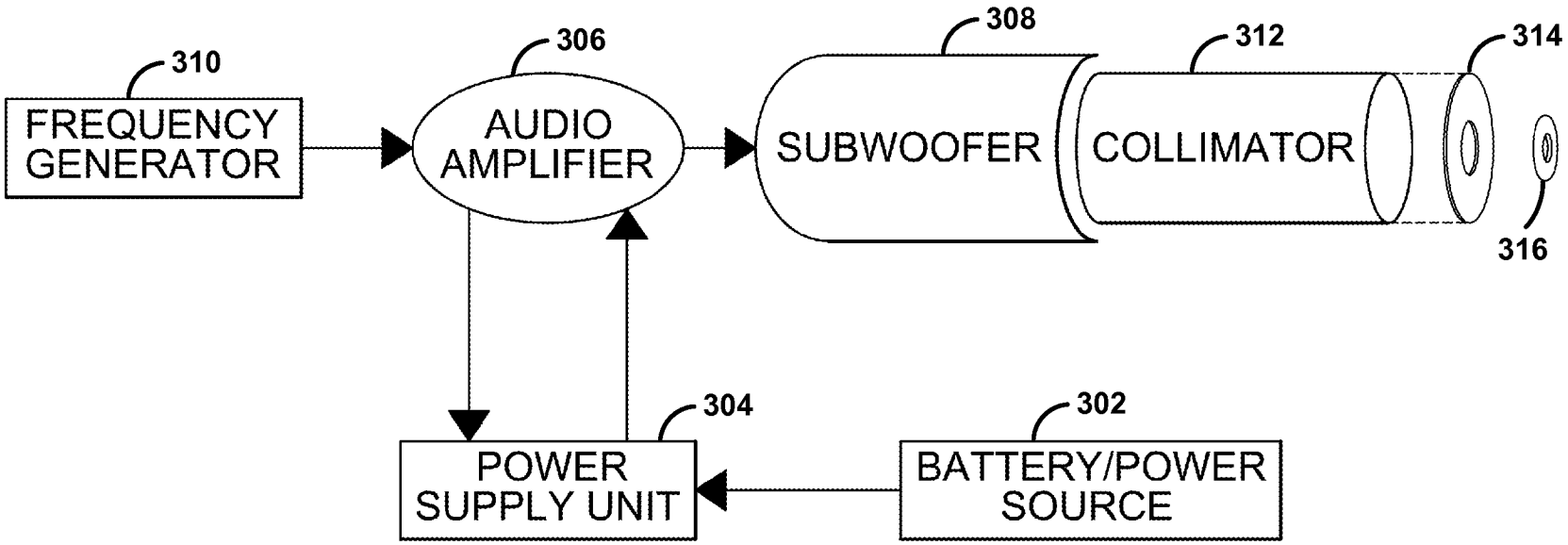
FIG. 3 is a diagram illustrating components of an example device.

FIG. 3 is a block diagram illustrating connectivity of components of an example device. The device 100 can comprise a power source, such as a battery, a power line, energy generating device (e.g., solar cell, turbine). The power source 302 can supply power to the power supply unit 304 (e.g., power unit 122). The power supply unit 304 can be electrically coupled to one or more components of the device 100, such as an audio amplifier 306, a subwoofer 308 (e.g., transducer 104), a frequency generator 310, and/or the like. In some implementations, the frequency generator 310 can have a separate power source (e.g., a separate battery). The frequency generator 310 can provide a signal to the audio amplifier 306. The audio amplifier 306 can increase the power (e.g., amplitude) of the signal (e.g., using the power received from the power supply unit 304). The audio amplifier 306 can supply the amplified signal to the subwoofer 308. The subwoofer 308 can emit a wave into a collimator 312. The collimator 312 can direct the wave along a path and/or in a particular direction. The wave can exit the collimator 312 via a cap 314 (e.g., a vortex nozzle) comprise an outlet. The cap 314 can cause the wave to form as one or more vortex ring 316. The one or more vortex rings 316 can form a channel in a medium (e.g., air, atmosphere).

FIG. 4A illustrates an example telescoping wave enhancer 108. The wave enhancer 108 can be portable. For example, the wave enhancer 108 can be adjustable for storing and/or carry the wave enhancer 108. The wave enhancer 108 can comprise one or more telescoping members. The telescoping members can be extendable to elongate the chamber for use. The telescoping members can be collapsible (e.g., within each other), thereby reducing the length of the wave enhancer 108. For example, a first telescoping member 402 can be slideable within a second telescoping member 404. The first telescoping member 402 and the second telescoping member 404 can be slideable within a base member 406. The first telescoping member 402 can be slideable at least partially outside the second telescoping member 404 to increase the length of the wave enhancer 108. The first telescoping member 402 and the second telescoping member 404 can be slideable at least partially outside the base member 405 to increase the length of the wave enhancer 108. The first telescoping member 402 and/or the second telescoping member 404 can be locked in place and/or unlocked (e.g., to allow for collapsing into the base member 405.

Figure 4B:
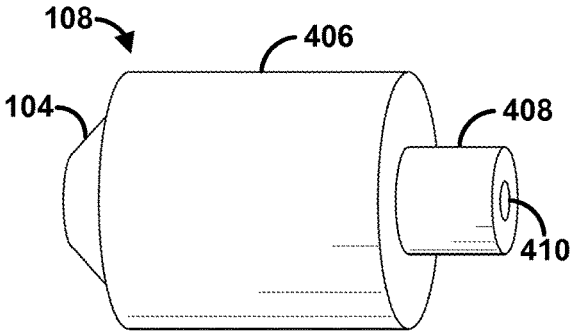
FIG. 4B illustrates an example multistage wave enhancer.

FIG. 4B illustrates an example multistage wave enhancer 108. The wave enhancer 108 can comprise a first stage 406 and a second stage 408. The second stage 408 can extend from the first stage 406. The second stage 408 can receive a wave generated by the transducer 104 from the first stage 406 and provide the wave via an outlet 410 of the second stage 408. The second stage 408 can be smaller in width (e.g., diameter) than the first stage 406. The second stage 408 can focus and/or channel a wave from the first stage into a smaller channel (e.g., thereby increasing the power, velocity, and/or the like of the wave).

Figure 4C:
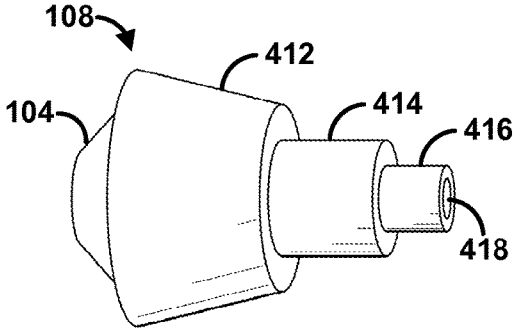
FIG. 4C illustrates another example multistage wave enhancer.
Figure 4D:
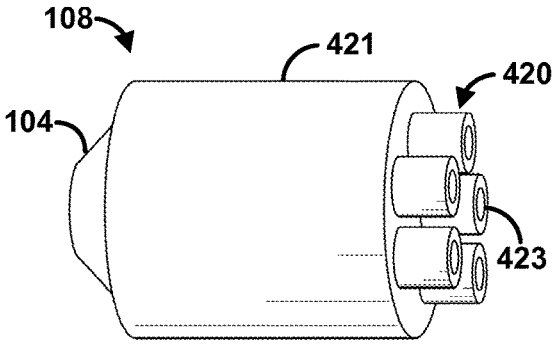
FIG. 4D illustrates an example wave enhancer with a plurality of second stages.
Figure 4E:
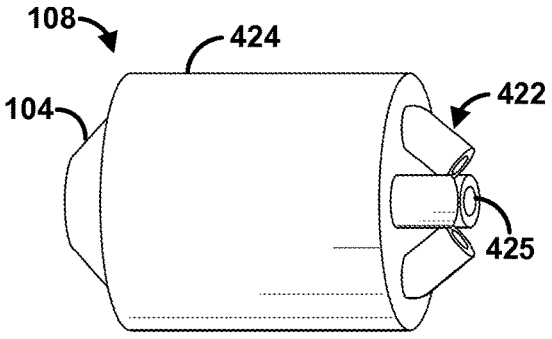
FIG. 4E illustrates an another example wave enhancer with a plurality of second stages.

FIG. 4C illustrates another example multistage wave enhancer 108. The wave enhancer 108 can comprise a first stage 412, a second stage 414, and a third stage 416. The second stage 414 can extend from the first stage 412. The second stage 414 can receive a wave generated by the transducer 104 from the first stage 412 and provide the wave to the third stage 416. The third stage 416 can receive the wave from the second stage 414 and provide the wave via an outlet 418 of the third stage 408. The second stage 414 can be smaller in width (e.g., diameter) than the first stage 412. The third stage 416 can be smaller in width than the second stage 414. The second stage 414 can focus and/or channel a wave from the first stage 412 into a smaller channel (e.g., thereby increasing the power, velocity, and/or the like of the wave) than the first stage 412. The third stage 416 can focus and/ channel the wave from the second stage 414 into a smaller channel (e.g., thereby increasing the power, velocity, and/or the like of the wave) than the second stage 414.

FIG. 4D illustrates an example wave enhancer 108 with a plurality of second stages 420. For example, the plurality of second stages 420 can be configured to receive a wave from the first stage 421. The plurality of second stages 420 can each have a corresponding outlet 423. The plurality of second stages 420 can be configured to subdivide the wave into a plurality of waves (e.g., traveling substantially parallel to each other as the plurality of waves exit the plurality of second stages 420). For example, the plurality of second stages 420 can convert the wave into a plurality of vortex rings.

FIG. 4E illustrates an another example chamber 110 with a plurality of second stages 422. The plurality of second stages 422 can receive a wave generated by a transducer 104 from a first stage 424. Each of the plurality of second stages 422 can comprise corresponding outlets 425. The plurality of second stages 422 can be angled (e.g., from the first stage, to focus portions of the wave on a focal point). The outlets of the plurality of second stages 422 can be configured to form the wave into at least two vortex rings. The at least two vortex rings can converge at the focal point to form an enhanced wave channel parallel to the axis of the first stage 424.

In an aspect, the device 102 can be configured for beamforming. For example, the device 102 can comprise a plurality of transducers 104 (e.g., an array of transducers).

The plurality of transducers 104 can output a pattern of waves. The pattern of waves can be directed to one or more focal points. The plurality of transducers 104 can be coupled to (e.g., attached to, provide corresponding waves to) a plurality of wave enhancers 108. In another aspect, a single wave enhancer 108 can provide a wave that can be split into a plurality of waves. The plurality of waves can be directed (e.g., via a plurality of outlets) to one or more focal points. The plurality of waves can be directed at one or more angles (e.g., 5 degrees, 10 degrees, 15 degrees, 20 degrees, 30 degrees, 45 degrees).

Figure 5A:
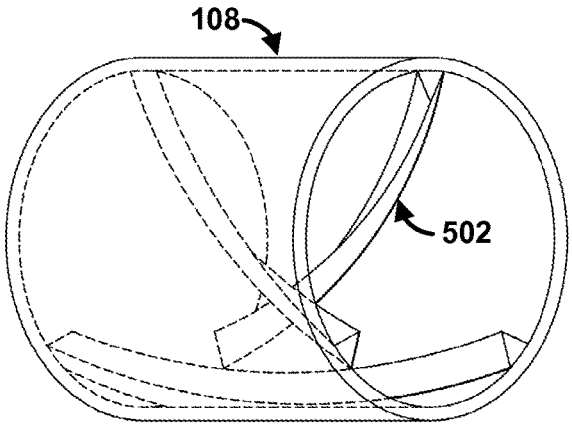
FIG. 5A shows a side view of a wave enhancer comprising protrusions.
Figure 5B:
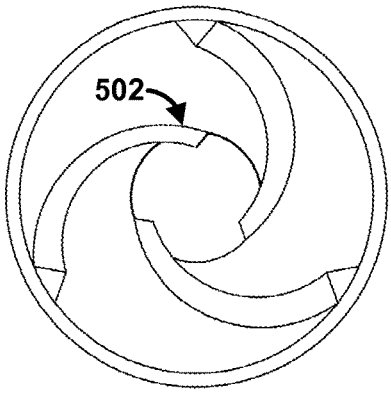
FIG. 5B shows a view along the axis of the wave enhancer of the example protrusions.

FIG. 5A and FIG. 5B illustrate another example wave enhancer 108. FIG. 5A shows a side view of a wave enhancer 108 having protrusions 502. FIG. 5B shows a view along the axis 116 of the wave enhancer 108 of the example protrusions 502. The wave enhancer 108 can be configured to induce a rotation in at least a portion of the wave. The rotation can be around an axis in the direction of travel of the wave. For example, the rotation can be caused by protrusions 502 (e.g., fins) and/or indentations and/or the like. The indentations and/or protrusions 502 (e.g. fins) can be disposed in the wave enhancer 108. The protrusions 502 can extend from the inner walls of the wave enhancer 108 (e.g., or chamber 110) towards the interior of the wave enhancer 108. The indentations can be disposed into the inner walls of the chamber. The indentations and/or protrusions 502 can be helically shaped. For example, the indentations and/or protrusions 502 can be in the shape of a helix along the length of the wave enhancer 108 (e.g., along the axis of the direction of travel of the wave).

Figure 6:
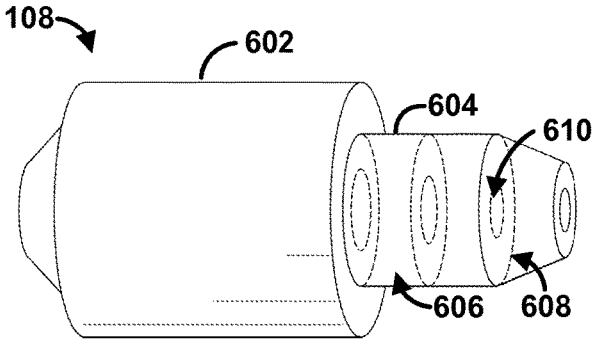
FIG. 6 illustrates an example wave enhancer comprising successive outlets.

FIG. 6 illustrates an example wave enhancer 108 comprising successive outlets. The wave enhancer 108 can comprise a first stage 602 and a second stage 604. The second stage 604 can comprise multiple inner stages 606. Each of the inner stages 606 can be separated by a transition wall 608 configured to restrict the wave through an outlet 610.

Figure 7:
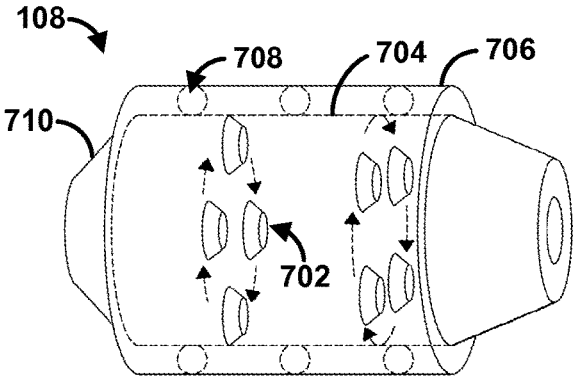
FIG. 7 illustrates an example wave enhancer with rotating transducers.

FIG. 7 illustrates an example wave enhancer 108 with rotating transducers. For example, the wave enhancer 108 can comprise a plurality of transducers 702. The example wave enhancer 108 can comprise an inner chamber 704 and an outer chamber 706 The plurality of transducers 702 can be fixed to and/or extend from an inner wall of the inner chamber 704. In some scenarios, the plurality of transducers 702 can be disposed along one or more helical paths (e.g. spiral path extending down the axis 116 of the wave enhancer 108) along the inner wall of the inner chamber 704. A plurality of friction reducers 708 can be disposed between the inner chamber 704 and the outer chamber 706. For example, the plurality of friction reducers 708 can comprise ball bearings. The inner chamber 704 can be configured to rotate with respect to the outer chamber 706. For example, the operation (e.g., generation of waves) of the plurality of transducers 702 can cause the inner chamber 704 to rotate. As another example, a transducer 710 (e.g., a motor) can be coupled to the inner chamber 704. The transducer 710 can apply mechanical force to the inner chamber 704, thereby causing the inner chamber 704 to rotate.

Figure 8:
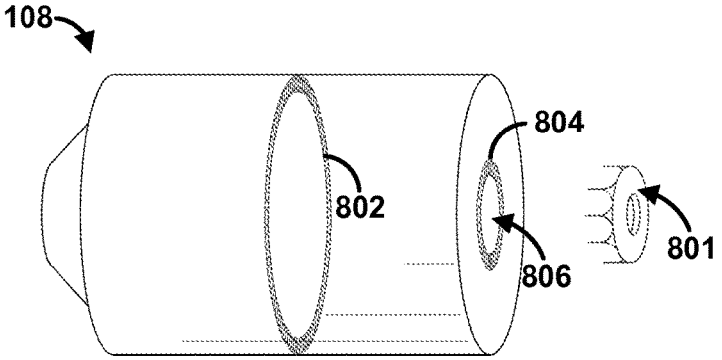
FIG. 8 illustrates an example wave enhancer configured for generating an electromagnetic wave.

FIG. 8 illustrates an example wave enhancer 108 configured for generating an electromagnetic wave, such as an electromagnetic longitudinal wave. The wave enhancer 108 can comprise one or more electromagnetic wave generator. The one or more electromagnetic wave generators can be configured to generate electromagnetic waves 801, such as longitudinal electromagnetic waves. As an example, the electromagnetic wave generator can comprise an array of magnets, a wire (e.g., a coiled wire), and/or the like. For example, a first electromagnetic wave generator 802 can be disposed within the wave enhancer 108 (e.g., around an interior wall of the wave enhancer 108). A second electromagnetic wave generator 804 can be disposed around an outlet 806.

FIG. 9 illustrates an example wave enhancer 108 comprising a cone shaped member 902. For example, the cone shaped member 902 can be coupled to the transducer 104. The cone shaped member 902 can amplify the wave from the transducer 104. In some implementations, the transducer 104 can be disposed at least partially within the wave enhancer 108. For example, the transducer 104 can be configured to (e.g., face away from the outlet 903) provide a wave in the direction opposite from the outlet 903 of the cone shaped member 902. A closed end (e.g., top of the cone shaped member 902, smaller end of the cone shaped member 902) of the cone shaped member 902 can receive (e.g. and focus, magnify, amplify) the wave and provide the wave to the outlet 903.

Figure 11:
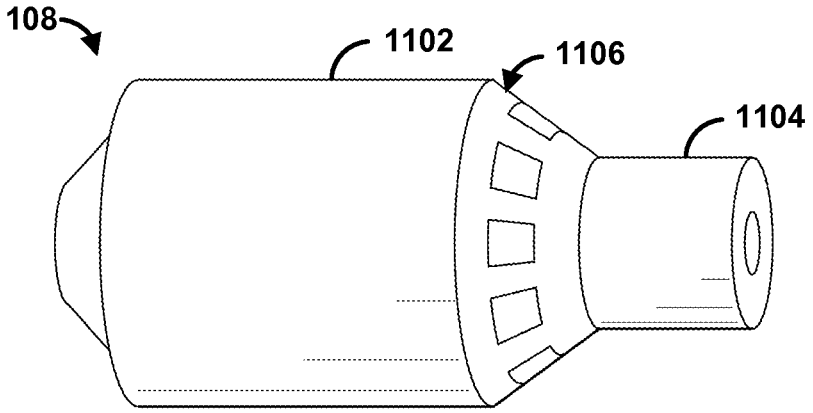
FIG. 11 illustrates an example wave enhancer comprising a primary stage and a secondary stage.
Figure 12:
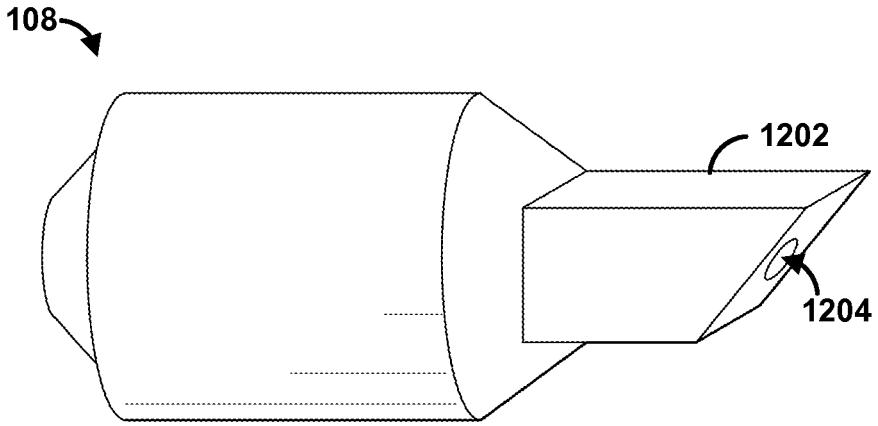
FIG. 12 illustrates an example wave enhancer comprising a rectangular stage.
Figure 13:
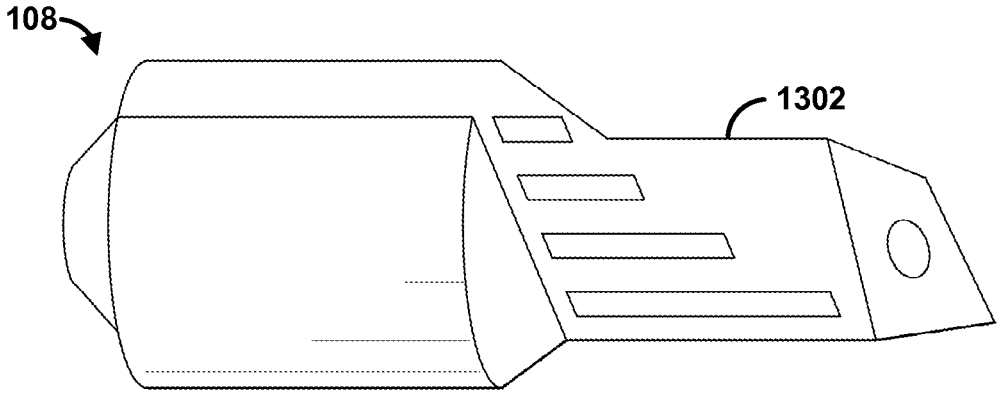
FIG. 13 illustrates another example wave enhancer.

FIG. 10 illustrates another example wave enhancer 108 comprising the cone shaped member 902. The wave enhancer 108 can comprise a cylindrical member 904 coupled between the cone shaped member 902 and the transducer 104. FIG. 11 illustrates an example wave enhancer 108 comprising a primary stage 1102 and a secondary stage 1104. The primary stage 1102 can be wider than the secondary stage 1104. The chamber 110 can comprise a transition 1106 between the primary stage 1102 and the secondary stage 1104. The transition 1106 can be angled from a wall of the primary stage 1102 to a wall of the secondary stage 1104. FIG. 12 illustrates an example wave enhancer 108 comprising a rectangular stage 1202. The rectangular stage 1202 can comprise an angled outlet 1204. FIG. 13 illustrates another example wave enhancer 108 comprising a rectangular stage 1302. FIG. 14 illustrates a variety of example caps 118. For example, any of the caps 118 illustrated can be affixed to the chamber to provide a variety of different waves from the wave enhancer 108. The alternative designs of the cap 118 can comprise varying configurations of outlets 114 designed to optimize wave flow, air flow, velocity, concentration, and/or the like.

Figure 15:
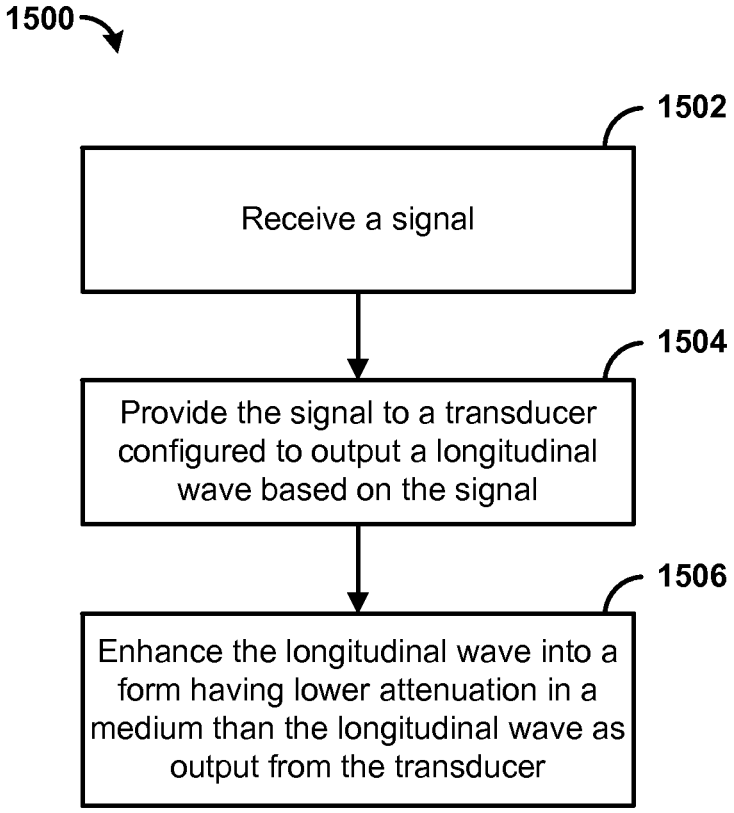
FIG. 15 is a flowchart illustrating an example method for disrupting phenomena.

FIG. 15 is a flowchart illustrating an example method for disrupting phenomena. In an aspect, a signal can be generated with a signal generator. The signal generator can be any computing or electrical device configured to generate a signal. For example, the signal generator can be a circuit specific designed for generating signal. The signal generator can comprise a portable computing device, such as a mobile device (e.g., mobile phone, smart phone, smart watch, smart glasses. The signal can be selected based on a frequency associated with a chemical reaction. The signal can be configured to cause the wave (e.g., longitudinal wave) to oscillate such that a fuel source of a chemical reaction receiving the wave is disrupted thereby reducing or stopping the chemical reaction. The signal can have a frequency configured to cause the wave to disrupt a fire. The frequency can be within a range from about 20 Hz to about 160 Hz.

At step 1502, the signal can be received. For example, the signal can be received from a signal generator. The signal can be received by a computing device. For example, the signal can be received at an integrated circuit, a computer processor, a microcontroller, an amplifier, and/or the like. The signal can be stored in memory. A user can select the signal for disrupting a chemical reaction. In some scenarios, the computing device can automatically select the signal based on a detected characteristic (e.g., temperature, materials, chemical byproducts, flame color) of the chemical reaction. In an aspect, the signal can be amplified.

At step 1504, the signal (e.g., or amplified signal) can be provided to a transducer configured to output a wave based on the signal. The wave can comprise a transverse wave and/or a longitudinal wave. For example, the wave can comprise a pressure wave, an acoustic wave, and/or the like. The wave can comprise an electromagnetic wave, such as a transverse electromagnetic wave and/or longitudinal electromagnetic wave.

The transducer can comprise any device configured to produce a wave (e.g., longitudinal wave). The transducer can comprise a piston configured to move air. The transducer can be configured to generate alternating compressions and rarefactions in a medium. The transducer can comprise a plate (e.g., flat plate) and/or diaphragm configured to oscillate based on the signal. The plate and/or diaphragm can be moved by a motor (e.g., electromagnetic and/or mechanical motor). For example, the transducer can comprise an audio speaker. The plate and/or diaphragm can be manually controlled. For example, the plate and/or diaphragm can be pulled back and released (e.g., generating a single impulse).

At step 1506, the wave can be enhanced into a form having lower attenuation in a medium than the wave as output from the transducer. In an aspect, enhancing the longitudinal wave can comprise channeling the longitudinal wave into a chamber comprising an inlet receiving the wave. The chamber can direct the longitudinal wave out of an outlet of the chamber.

Enhancing the longitudinal wave can comprise aligning the longitudinal wave along an axis of a chamber. The chamber can be an elongated chamber. The chamber can be a portable chamber. For example, the chamber can be adjustable for storing and/or carry the chamber. The chamber can comprise one or more telescoping members. The telescoping members can be extendable to elongate the chamber for use. The telescoping members can be collapsible (e.g., within each other), thereby reducing the length of the chamber. For example, a first telescoping member can be slideable within a second telescoping member. The first telescoping member can be slideable at least partially outside the second telescoping member to increase the length of the chamber.

Enhancing the wave can comprise inducing a rotation in at least a portion of the wave. The rotation can be around an axis in the direction of travel of the wave. For example, the rotation can be caused by grooves and/or fins. The grooves and/or fins can be disposed in the chamber. The fins can extend from the inner walls of the chamber into the chamber. The grooves can be disposed into the inner walls of the chamber. The grooves and/or fins can be helically shaped. For example, the grooves and/or fins can be in the shape of a helix along the length of the chamber (e.g., along the axis of the direction of travel).

The outlet can be configured to cause at least a portion of the longitudinal wave to rotate as the wave travels away from (e.g., out of the) the chamber. The rotation can be around an axis formed as a closed loop. For example, the outlet can form the wave into a vortex ring. The axis can be an axis of the vortex ring (e.g., around which air rotates). As the signal may be continuous, the wave can form a continuum of successive vortex rings. The wave can form a channel in the medium based on one or more vortex rings. For example, the rotation can be caused by channeling a jet stream into a medium. The medium can have a relatively slow velocity in comparison to the jet stream. The jet stream can rotate (e.g., in the form of a vortex ring) as the jet stream interfaces with (e.g., collides with, pushes against) the medium.

Enhancing the longitudinal wave can comprise increasing a velocity of at least a portion of the longitudinal wave. The velocity can be increased by channeling the wave along the chamber. The velocity can be increased by channeling the wave though an outlet narrower than the chamber. For example, the outlet can comprise a nozzle. In an aspect, enhancing the longitudinal wave can comprise channeling the longitudinal wave through a chamber from inlet of the chamber to an outlet of the chamber. The wave can exit the wave chamber through the outlet. The outlet can be smaller than the inlet. In another aspect, the inlet can be smaller than the outlet. The outlet of the chamber can be adjusted. The wave can be focused as the wave exits the outlet of a chamber. For example, enhancing the wave can comprise channeling the wave through at least two outlets of a chamber. The at least two outlets can be configured to focus portions of the wave on a focal point. The at least two outlets can be configured to form the wave into at least two vortex rings.

In an aspect, the method 1500 can further comprise supplying gas to the wave to cause the wave to carry the gas. The gas can be a gas with chemical reaction suppressing properties (e.g., flame suppressing properties). The gas can be a gas that is incompatible with the chemical reaction. The gas may be unable to be used as a fuel source of the chemical reaction. For example, the gas can comprise one or more noble gases, such as helium, neon, argon, krypton, xenon, radon, element 118 (e.g., ununoctium), and/or the like.

In an aspect, the method 1500 can further comprise cooling a plurality of molecules carrying the wave. For example, a cooling element can be disposed within the chamber. As another example, the cooling element can be disposed outside the chamber. The cooling element can provide the cooled plurality of air molecules into the chamber (e.g., before and/or while the wave is generated by the transducer). The cooling element can comprise a thermoelectric cooling element, such as a peltier cooling element. For example, the cooling element can use electrical energy to transfer heat out of an area (e.g., thereby cooling the area). For example, the cooling element can comprise two materials of different electron densities, such as an n-type semiconductor and a p-type semiconductors. The two material can be disposed thermally in parallel to each other and electrically in series. The two materials can be joined with a thermally conducting plate on each side. In some scenarios, the chamber walls can comprise the two materials. The exterior wall and interior wall of the chamber can comprise the thermally conducting plates. For example, the chamber can be configured to draw heat out an interior of the chamber and expel the heat outside the chamber.

In an aspect, the method 1500 can further comprise providing power to the transducer. The power can be provided from a battery. The power can be provided by an alternate energy source, such as light, water, wind, and/or the like. The power can be provided from an outlet and/or other electrical line. The power can be generated based on energy released by the chemical reaction. For example, a thermoelectric generator can be used to convert energy from the chemical reaction into an electrical current and/or electrical voltage.

In an aspect, the method 1500 can further comprise causing the wave to resonate within a chamber. For example, the signal can be selected based on the size of the chamber, such that the signal can resonate in the chamber. As another example, the dimensions (e.g., length or width) of the chamber can be adjustable. Adjusting the dimensions of the chamber to a resonate dimension can cause the wave to resonate within the chamber. As another example, the telescoping members of the chamber can be adjusted (e.g., decreasing or increasing length of the chamber) to change the resonate frequency of the chamber.

Figure 16:
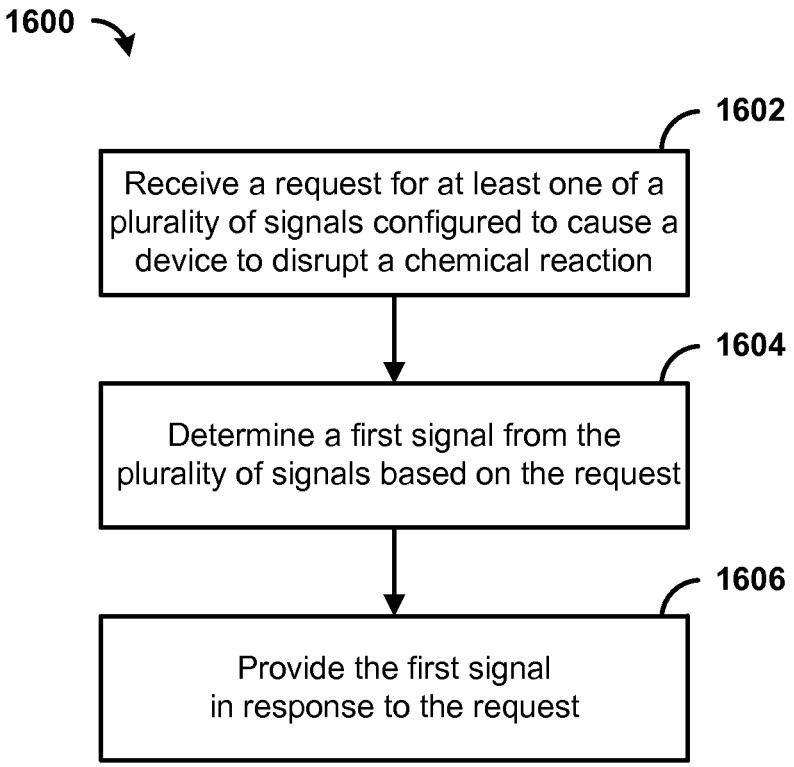
FIG. 16 is a flowchart illustrating an example method for providing a signal to disrupt phenomena.

FIG. 16 is a flowchart illustrating an example method for providing a signal to disrupt phenomena. At step 1602, a request for at least one of a plurality of signals configured to cause a device to disrupt a chemical reaction can be received. The request can identify information, such as the chemical reaction, the frequency of the chemical reaction, the temperature of the chemical reaction, the materials involved in the chemical reaction, and/or the like. For example, the information can be manually entered by a user. The information can be determined based on data collected from one or more sensors (e.g., infrared sensor, temperature sensor). The request can be to another device, such a computing device (e.g., server). The computing device can store a plurality of signals for distribution to one or more devices configured to disrupt chemical reaction.

At step 1604, a first signal from the plurality of signals can be determined based on the request. The first signal can be determined (e.g., selected) based on the chemical reaction. For example, different signals can be customized for disrupting different kinds of chemical reactions (e.g., involving different materials)

The first signal can be determined (e.g., selected) based on an identifier of the device. For example, different devices can be configured to generate different types of signals. The first signal can be determined (e.g., selected) based on a fuel of the chemical reaction. For example, different fuels can be associated with different signals. Some signals may be associated with alcohol. Other signals may be associated with oils. Other signals may be associated with wood and other solid flammables. The first signal can be determined (e.g., selected) based on a frequency associated with the chemical reaction. For example, different fuels can be disrupted (e.g., moved away from the chemical reaction) by different frequencies depending, for example, the size the molecules of the fuel, the atomic weight of the molecules, the state of the molecules (e.g., gas, liquid, solid), and/or the like.

At step 1606, the first signal can be provided in response to the request. The first signal can be provided as a data file. The first signal can be provided via a network, such as a wireless network.

Figure 17:
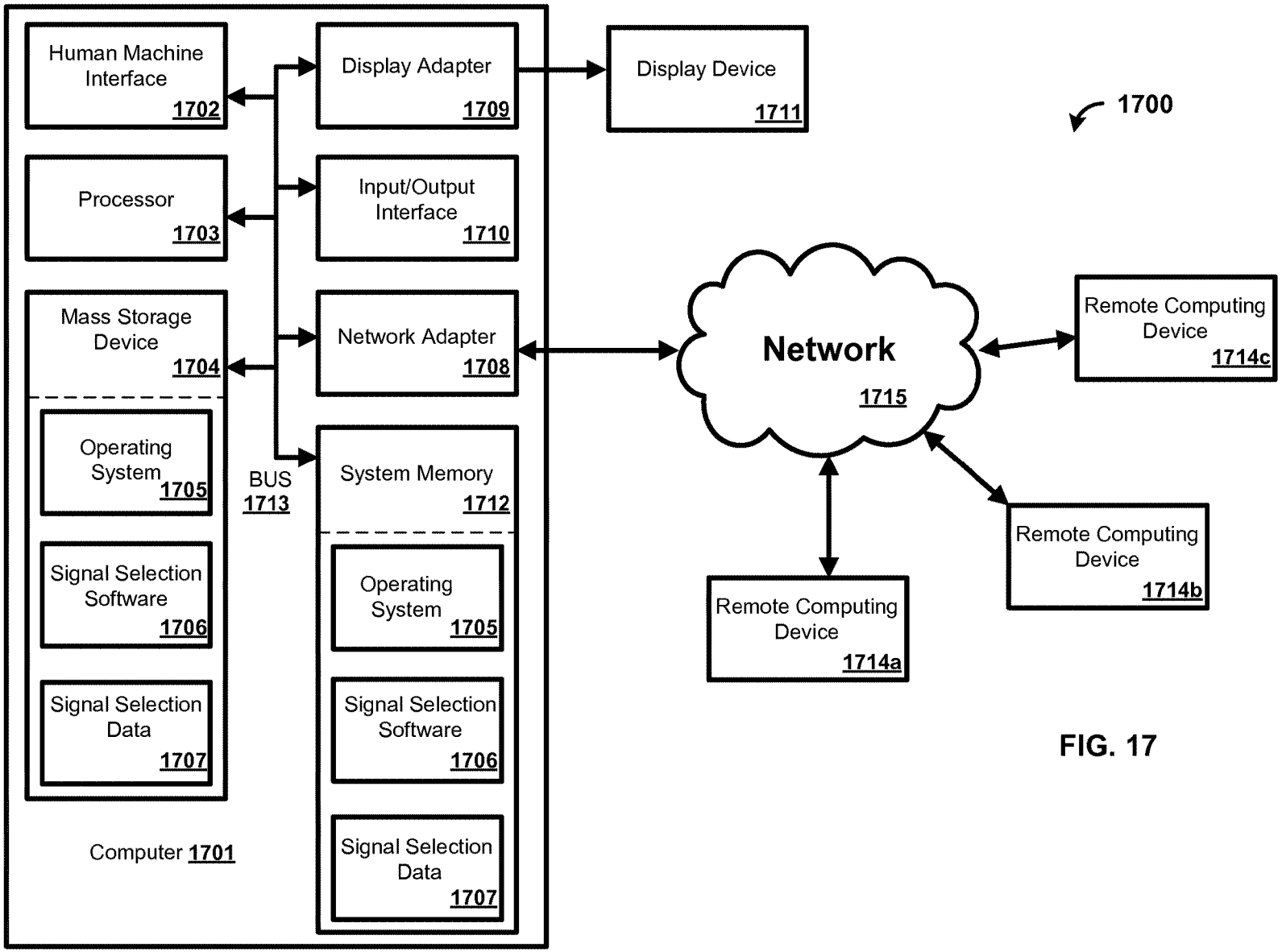
FIG. 17 is a block diagram illustrating an example computing device in which the disclosed methods and systems can operate.

In an exemplary aspect, the methods and systems can be implemented on a computer 1701 as illustrated in FIG. 17 and described below. By way of example, the control unit 102 of FIG. 1 can be a computer as illustrated in FIG. 17. Similarly, the methods and systems disclosed can utilize one or more computers to perform one or more functions in one or more locations. FIG. 17 is a block diagram illustrating an exemplary operating environment for performing the disclosed methods. This exemplary operating environment is only an example of an operating environment and is not intended to suggest any limitation as to the scope of use or functionality of operating environment architecture. Neither should the operating environment be interpreted as having any dependency or requirement relating to any one or combination of components illustrated in the exemplary operating environment.

The present methods and systems can be operational with numerous other general purpose or special purpose computing system environments or configurations. Examples of well-known computing systems, environments, and/or configurations that can be suitable for use with the systems and methods comprise, but are not limited to, personal computers, server computers, laptop devices, and multiprocessor systems. Additional examples comprise set top boxes, programmable consumer electronics, network PCs, minicomputers, mainframe computers, distributed computing environments that comprise any of the above systems or devices, and the like.

The processing of the disclosed methods and systems can be performed by software components. The disclosed systems and methods can be described in the general context of computer-executable instructions, such as program modules, being executed by one or more computers or other devices. Generally, program modules comprise computer code, routines, programs, objects, components, data structures, etc. that perform particular tasks or implement particular abstract data types. The disclosed methods can also be practiced in grid-based and distributed computing environments where tasks are performed by remote processing devices that are linked through a communications network. In a distributed computing environment, program modules can be located in both local and remote computer storage media including memory storage devices.

Further, one skilled in the art will appreciate that the systems and methods disclosed herein can be implemented via a general-purpose computing device in the form of a computer 1701. The components of the computer 1701 can comprise, but are not limited to, one or more processors 1703, a system memory 1712, and a system bus 1713 that couples various system components including the one or more processors 1703 to the system memory 1712. The system can utilize parallel computing.

The system bus 1713 represents one or more of several possible types of bus structures, including a memory bus or memory controller, a peripheral bus, an accelerated graphics port, or local bus using any of a variety of bus architectures. By way of example, such architectures can comprise an Industry Standard Architecture (ISA) bus, a Micro Channel Architecture (MCA) bus, an Enhanced ISA (EISA) bus, a Video Electronics Standards Association (VESA) local bus, an Accelerated Graphics Port (AGP) bus, and a Peripheral Component Interconnects (PCI), a PCI-Express bus, a Personal Computer Memory Card Industry Association (PCMCIA), Universal Serial Bus (USB) and the like. The bus 1713, and all buses specified in this description can also be implemented over a wired or wireless network connection and each of the subsystems, including the one or more processors 1703, a mass storage device 1704, an operating system 1705, signal selection software 1706, signal selection data 1707, a network adapter 1708, the system memory 1712, an Input/Output Interface 1710, a display adapter 1709, a display device 1711, and a human machine interface 1702, can be contained within one or more remote computing devices 1714*a,b,c* at physically separate locations, connected through buses of this form, in effect implementing a fully distributed system.

The computer 1701 typically comprises a variety of computer readable media. Exemplary readable media can be any available media that is accessible by the computer 1701 and comprises, for example and not meant to be limiting, both volatile and non-volatile media, removable and non-removable media. The system memory 1712 comprises computer readable media in the form of volatile memory, such as random access memory (RAM), and/or non-volatile memory, such as read only memory (ROM). The system memory 1712 typically contains data such as the signal selection data 1707 and/or program modules such as the operating system 1705 and the signal selection software 1706 that are immediately accessible to and/or are presently operated on by the one or more processors 1703.

In another aspect, the computer 1701 can also comprise other removable/non-removable, volatile/non-volatile computer storage media. By way of example, FIG. 17 illustrates the mass storage device 1704 which can provide non-volatile storage of computer code, computer readable instructions, data structures, program modules, and other data for the computer 1701. For example and not meant to be limiting, the mass storage device 1704 can be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like.

Optionally, any number of program modules can be stored on the mass storage device 1704, including by way of example, the operating system 1705 and the signal selection software 1706. Each of the operating system 1705 and the signal selection software 1706 (or some combination thereof) can comprise elements of the programming and the signal selection software 1706. The signal selection data 1707 can also be stored on the mass storage device 1704. The signal selection data 1707 can be stored in any of one or more databases known in the art. Examples of such databases comprise, DB2®, Microsoft® Access, Microsoft® SQL Server, Oracle®, mySQL, PostgreSQL, and the like. The databases can be centralized or distributed across multiple systems.

In another aspect, the user can enter commands and information into the computer 1701 via an input device (not shown). Examples of such input devices comprise, but are not limited to, a keyboard, pointing device (e.g., a "mouse"), a microphone, a joystick, a scanner, tactile input devices such as gloves, and other body coverings, and the like These and other input devices can be connected to the one or more processors 1703 via the human machine interface 1702 that is coupled to the system bus 1713, but can be connected by other interface and bus structures, such as a parallel port, game port, an IEEE 1394 Port (also known as a Firewire port), a serial port, or a universal serial bus (USB).

In yet another aspect, the display device 1711 can also be connected to the system bus 1713 via an interface, such as the display adapter 1709. It is contemplated that the computer 1701 can have more than one display adapter 1709 and the computer 1701 can have more than one display device 1711. For example, the display device 1711 can be a monitor, an LCD (Liquid Crystal Display), or a projector. In addition to the display device 1711, other output peripheral devices can comprise components such as speakers (not shown) and a printer (not shown) which can be connected to the computer 1701 via the Input/Output Interface 1710. Any step and/or result of the methods can be output in any form to an output device. Such output can be any form of visual representation, including, but not limited to, textual, graphical, animation, audio, tactile, and the like. The display device 1711 and computer 1701 can be part of one device, or separate devices.

The computer 1701 can operate in a networked environment using logical connections to one or more remote computing devices 1714*a,b,c*. By way of example, a remote computing device can be a personal computer, portable computer, smartphone, a server, a router, a network computer, a peer device or other common network node, and so on. Logical connections between the computer 1701 and a remote computing device 1714*a,b,c* can be made via a network 1715, such as a local area network (LAN) and/or a general wide area network (WAN). Such network connections can be through the network adapter 1708. The network adapter 1708 can be implemented in both wired and wireless environments. Such networking environments are conventional and commonplace in dwellings, offices, enterprise-wide computer networks, intranets, and the Internet.

For purposes of illustration, application programs and other executable program components such as the operating system 1705 are illustrated herein as discrete blocks, although it is recognized that such programs and components reside at various times in different storage components of the computing device 1701, and are executed by the one or more processors 1703 of the computer. An implementation of the signal selection software 1706 can be stored on or transmitted across some form of computer readable media. Any of the disclosed methods can be performed by computer readable instructions embodied on computer readable media. Computer readable media can be any available media that can be accessed by a computer. By way of example and not meant to be limiting, computer readable media can comprise "computer storage media" and "communications media." "Computer storage media" comprise volatile and non-volatile, removable and non-removable media implemented in any methods or technology for storage of information such as computer readable instructions, data structures, program modules, or other data. Exemplary computer storage media comprises, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

The methods and systems can employ Artificial Intelligence techniques such as machine learning and iterative learning. Examples of such techniques include, but are not limited to, expert systems, case based reasoning, Bayesian networks, behavior based AI, neural networks, fuzzy systems, evolutionary computation (e.g. genetic algorithms), swarm intelligence (e.g. ant algorithms), and hybrid intelligent systems (e.g. Expert inference rules generated through a neural network or production rules from statistical learning).

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

Throughout this application, various publications are referenced. The disclosures of these publications in their entireties are hereby incorporated by reference into this application in order to more fully describe the state of the art to which the methods and systems pertain.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

What is claimed is:

1. A device comprising:

a transducer configured to receive a signal comprising a frequency and output a longitudinal wave comprising a plurality of pressure pulses spaced according to the frequency; and a wave enhancer coupled to the transducer and configured to direct the longitudinal wave along a longitudinal axis of the wave enhancer and output the longitudinal wave into a form that is at least partially rotating, wherein the longitudinal wave output from the wave enhancer causes disruption of a fuel source of a chemical reaction receiving the longitudinal wave thereby suppressing a fire.

2. The device of claim 1, wherein the wave enhancer comprises an outlet configured to cause at least a portion of the longitudinal wave to rotate as the longitudinal wave travels away from the wave enhancer.

3. The device of claim 1, wherein the form comprises a vortex ring.

4. The device of claim 1, wherein the transducer and the wave enhancer are portable.

5. The device of claim 1, wherein the wave enhancer comprises a collimator configured to align the longitudinal wave along a path directed by the collimator.

6. The device of claim 1, wherein the signal is selected based on a frequency associated with the chemical reaction.

7. The device of claim 1, further comprising a gas canister coupled to the wave enhancer and configured to cause the longitudinal wave to carry gas provided by the gas canister.

8. The device of claim 1, further comprising a cooling element configured to cause the longitudinal wave to carry cooled molecules.

9. The device of claim 1, further comprising an amplifier electrically coupled to the transducer and configured to amplify the signal for the transducer.

10. The device of claim 1, wherein the wave enhancer is tunable to cause resonation of the longitudinal wave within the wave enhancer.

11. The device of claim 1, wherein the wave enhancer has curved walls configured to focus the longitudinal wave as the longitudinal wave exits an outlet.

12. The device of claim 1, wherein the wave enhancer comprises an outlet having an adjustable size for allowing the longitudinal wave to travel out of the wave enhancer.

13. The device of claim 1, wherein the wave enhancer comprises at least two outlets.

14. The device of claim 13, wherein the at least two outlets are configured to focus portions of the longitudinal wave on a focal point.

15. The device of claim 1, wherein the frequency is within a range from about 20 Hz to about 160 Hz.

16. The device of claim 1, wherein the plurality of pressure pulses comprise compressions in a medium separated by rarefactions in the medium.

17. A method comprising:

receiving a signal comprising a frequency;

providing the signal to a transducer configured to output a longitudinal wave based on the signal, wherein the longitudinal wave comprises a plurality of pressure pulses spaced according to the frequency; and enhancing, via a wave enhancer, the longitudinal wave into a form that is directionally oriented and at least partially rotating, wherein the longitudinal wave output from the wave enhancer causes disruption of a fuel source of a chemical reaction receiving the longitudinal wave thereby suppressing a fire.

18. The method of claim 17, wherein enhancing the longitudinal wave comprises inducing a rotation in at least a portion of the longitudinal wave, wherein the rotation is around an axis formed as a closed loop.

19. The method of claim 17, wherein the form comprises a vortex ring.

20. The method of claim 17, wherein the longitudinal wave is enhanced via a portable chamber.

21. The method of claim 17, wherein the transducer comprises an audio speaker and the longitudinal wave comprises an acoustic wave.

22. The method of claim 17, wherein the signal is selected based on a frequency associated with the chemical reaction.

23. The method of claim 17, further comprising supplying gas to the longitudinal wave to cause the longitudinal wave to carry the gas.

24. The method of claim 17, wherein the longitudinal wave is enhanced via an outlet of a chamber, and wherein the outlet is configured to cause at least a portion of the longitudinal wave to rotate as the longitudinal wave travels away from the chamber.

25. The method of claim 17, further comprising cooling a plurality of molecules carrying the longitudinal wave.

26. The method of claim 17, further comprising amplifying the signal and providing the amplified signal to the transducer.

27. The method of claim 17, further comprising causing the longitudinal wave to resonate within a chamber.

28. The method of claim 17, further comprising adjusting an outlet of a chamber, wherein the longitudinal wave exits the chamber through the outlet.

29. The method of claim 17, wherein enhancing the longitudinal wave comprises channeling the longitudinal wave through at least two outlets of a chamber.

30. The method of claim 29, wherein the at least two outlets are configured to focus portions of the longitudinal wave on a focal point.

31. The method of claim 17, wherein the frequency is within a range from about 20 Hz to about 160 Hz.

32. A device comprising:

a transducer configured to receive a signal comprising a frequency and output a longitudinal wave comprising a plurality of pressure pulses spaced according to the frequency; and a wave enhancer coupled to the transducer and configured to direct the longitudinal wave along a longitudinal axis of the wave enhancer and output the longitudinal wave in a vortex form configured to cause suppression of a fire.

33. The device of claim 32, further comprising:

a sensor configured to detect a characteristic of the fire, wherein the characteristic comprises one or more of a frequency of the fire, a chemical in the fire, or temperature of the fire; and a processor configured cause an update to the frequency based on the detected characteristic of the fire.

34. The device of claim 32, wherein the vortex form comprises one or more of a poloidal vortex or a toroidal vortex.

35. The device of claim 32, wherein the frequency of the signal is within a range from about 20 Hz to about 160 Hz.

36. The device of claim 32, wherein the plurality of pressure pulses comprise compressions in a medium separated by rarefactions in the medium spaced such that one or more of oxygenation stability of the fire is disrupted or fuel stability of the fire is disrupted.

* * * * *